US009120007B2

(12) United States Patent
Costello et al.

(10) Patent No.: US 9,120,007 B2
(45) Date of Patent: Sep. 1, 2015

(54) NETWORK GAMING ARCHITECTURE, GAMING SYSTEMS, AND RELATED METHODS

(75) Inventors: Andrew Costello, Las Vegas, NV (US); Lance Lockwood, Las Vegas, NV (US); Justin Scott, Las Vegas, NV (US); Louis J. Castle, II, Las Vegas, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 450 days.

(21) Appl. No.: 13/353,194

(22) Filed: Jan. 18, 2012

(65) Prior Publication Data

US 2013/0184079 A1 Jul. 18, 2013

(51) Int. Cl.
*A63F 9/24* (2006.01)

(52) U.S. Cl.
CPC ..... *A63F 9/24* (2013.01)

(58) Field of Classification Search
CPC ..... G07F 17/3202; G07F 17/3225
USPC ..... 463/42
See application file for complete search history.

(56) References Cited

U.S. PATENT DOCUMENTS

| | | | |
|---|---|---|---|
| 4,339,798 | A | 7/1982 | Hedges et al. |
| 4,373,726 | A | 2/1983 | Churchill et al. |
| 4,592,377 | A | 6/1986 | Paulsen et al. |
| 4,725,079 | A | 2/1988 | Koza et al. |
| 4,832,341 | A | 5/1989 | Muller et al. |
| 4,948,138 | A | 8/1990 | Pease et al. |
| 5,007,649 | A | 4/1991 | Richardson |
| 5,083,800 | A | 1/1992 | Lockton |
| 5,179,517 | A | 1/1993 | Sarbin et al. |
| 5,199,710 | A | 4/1993 | Lamle |
| 5,258,837 | A | 11/1993 | Gormley |
| 5,275,400 | A | 1/1994 | Weingardt et al. |
| 5,321,241 | A | 6/1994 | Craine |

(Continued)

FOREIGN PATENT DOCUMENTS

| | | | |
|---|---|---|---|
| CA | 2 529 076 | A1 | 6/2006 |
| DE | 19940954 | A1 | 3/2001 |

(Continued)

OTHER PUBLICATIONS

International Search Report and Written Opinion for co-pending application PCT/US13/21959, dated May 10, 2013.

(Continued)

*Primary Examiner* — Reginald Renwick
(74) *Attorney, Agent, or Firm* — Frank Abramonte; Marvin A. Hein; Philip J. Anderson

(57) ABSTRACT

A gaming system, a network gaming architecture, and related methods are disclosed that provides game content to server-based gaming platforms. Players access game content and place wagers on through a client server. The client server may act as a thin client to the gaming platform such that the client server establishes the communication link to a remote gaming engine that performs game play processing. The gaming system includes the remote gaming engine, which may comprise a game rules server configured to administer a set of game rules for the wagering game, and a deck server that randomly selects game pieces according to the set of game rules. A network gaming architecture includes separating functions that require regulation on one set of regulated servers, and functions that do not require regulation on at least one unregulated server.

13 Claims, 5 Drawing Sheets

(56) References Cited

U.S. PATENT DOCUMENTS 5,324,035 A 6/1994 Morris et al.
5,326,104 A 7/1994 Pease et al.
5,386,103 A 1/1995 DeBan et al.
5,398,932 A 3/1995 Eberhardt et al.
5,413,353 A 5/1995 Demarest et al.
5,472,194 A 12/1995 Breeding et al.
5,493,613 A 2/1996 Denno et al.
5,505,449 A 4/1996 Eberhardt et al.
5,507,489 A 4/1996 Reibel et al.
5,562,284 A 10/1996 Stevens
5,580,311 A 12/1996 Haste, III
5,603,502 A 2/1997 Nakagawa
5,605,334 A 2/1997 McCrea, Jr.
5,605,506 A 2/1997 Hoorn et al.
5,613,680 A 3/1997 Groves et al.
5,613,912 A 3/1997 Slater
5,643,086 A 7/1997 Alcorn et al.
5,655,961 A 8/1997 Acres et al.
5,707,286 A 1/1998 Carlson
5,707,287 A 1/1998 McCrea, Jr.
5,737,418 A 4/1998 Saffari et al.
5,741,183 A 4/1998 Acres et al.
5,745,110 A 4/1998 Ertemalp
5,759,102 A 6/1998 Pease et al.
5,770,533 A 6/1998 Franchi
RE35,864 E 7/1998 Weingardt
5,779,545 A 7/1998 Berg et al.
5,800,268 A 9/1998 Molnick
5,813,912 A 9/1998 Shultz
5,823,879 A 10/1998 Goldberg et al.
5,830,067 A 11/1998 Graves et al.
5,830,068 A 11/1998 Brenner et al.
5,830,069 A 11/1998 Soltesz et al.
5,850,447 A 12/1998 Peyret
5,851,149 A 12/1998 Xidos et al.
5,890,963 A 4/1999 Yen
5,895,451 A 4/1999 Yamade et al.
5,905,847 A 5/1999 Kobayashi et al.
5,911,626 A 6/1999 McCrea, Jr.
5,957,776 A 9/1999 Hoehne
5,971,851 A 10/1999 Pascal et al.
5,974,135 A 10/1999 Breneman et al.
5,999,808 A 12/1999 LaDue
6,001,016 A 12/1999 Walker et al.
6,042,150 A 3/2000 Daley
6,047,322 A 4/2000 Vaid et al.
6,068,553 A 5/2000 Parker
6,077,161 A 6/2000 Wisler
6,080,063 A 6/2000 Khosla
6,089,980 A 7/2000 Gauselmann
6,093,103 A 7/2000 McCrea, Jr.
6,102,799 A 8/2000 Stupak
6,104,815 A 8/2000 Alcorn et al.
6,106,396 A 8/2000 Alcorn et al.
6,110,041 A 8/2000 Walker et al.
6,110,043 A 8/2000 Olsen
6,117,012 A 9/2000 McCrea, Jr.
6,135,887 A 10/2000 Pease et al.
6,142,872 A 11/2000 Walker et al.
6,146,273 A 11/2000 Olsen
6,149,522 A 11/2000 Alcorn et al.
6,152,824 A 11/2000 Rothschild et al.
6,165,069 A 12/2000 Sines et al.
6,166,763 A 12/2000 Rhodes et al.
6,168,523 B1 1/2001 Piechowiak et al.
6,183,366 B1 2/2001 Goldberg et al.
6,185,184 B1 2/2001 Mattaway et al.
6,186,892 B1 2/2001 Frank et al.
6,210,274 B1 4/2001 Carlson
6,210,277 B1 4/2001 Stefan
6,217,447 B1 4/2001 Lofink et al.
6,219,836 B1 4/2001 Wells et al.
6,234,898 B1 5/2001 Belamant et al.
6,244,958 B1 6/2001 Acres
6,251,014 B1 6/2001 Stockdale et al.
6,254,483 B1 7/2001 Acres
6,254,484 B1 7/2001 McCrea, Jr.
6,256,651 B1 7/2001 Tuli
6,264,561 B1 7/2001 Saffari et al.
6,272,223 B1 8/2001 Carlson
6,275,586 B1 8/2001 Kelly
6,279,910 B1 8/2001 de Keller
6,287,202 B1 9/2001 Pascal et al.
6,302,793 B1 10/2001 Fertitta, III et al.
6,312,332 B1 11/2001 Walker et al.
6,319,125 B1 11/2001 Acres
6,325,375 B1 12/2001 Potter et al.
6,336,859 B2 1/2002 Jones et al.
6,346,044 B1 2/2002 McCrea, Jr.
6,362,836 B1 3/2002 Shaw et al.
6,380,953 B1 4/2002 Mizuno
6,383,076 B1 5/2002 Tiedeken
6,389,126 B1 5/2002 Bjornberg et al.
6,394,900 B1 5/2002 McGlone et al.
6,400,272 B1 6/2002 Holtzman et al.
6,401,099 B1 6/2002 Koppolu et al.
6,409,602 B1 6/2002 Wiltshire et al.
6,439,996 B2 8/2002 LeMay et al.
6,443,839 B2 9/2002 Stockdale et al.
6,459,882 B1 10/2002 Palermo et al.
6,460,848 B1 10/2002 Soltys et al.
6,464,584 B2 10/2002 Oliver
6,488,581 B1 12/2002 Stockdale
6,488,585 B1 12/2002 Wells et al.
6,490,285 B2 12/2002 Lee et al.
6,503,147 B1 1/2003 Stockdale et al.
6,505,772 B1 1/2003 Mollett et al.
6,508,709 B1 1/2003 Karmarkar
6,508,710 B1 1/2003 Paravia et al.
6,516,350 B1 2/2003 Lumelsky et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,527,638 B1 3/2003 Walker et al.
6,530,836 B2 3/2003 Soltys et al.
6,530,837 B2 3/2003 Soltys et al.
6,533,276 B2 3/2003 Soltys et al.
6,533,658 B1 3/2003 Walker et al.
6,533,662 B2 3/2003 Soltys et al.
6,575,833 B1 6/2003 Stockdale
6,578,847 B1 6/2003 Hedrick et al.
6,579,180 B2 6/2003 Soltys et al.
6,579,181 B2 6/2003 Soltys et al.
6,581,747 B1 6/2003 Charlier et al.
6,595,857 B2 7/2003 Soltys et al.
6,607,441 B1 8/2003 Acres
6,609,978 B1 8/2003 Paulsen
6,612,928 B1 9/2003 Bradford et al.
6,629,184 B1 9/2003 Berg et al.
6,638,170 B1 10/2003 Crumby
6,641,484 B2 11/2003 Oles et al.
6,645,077 B2 11/2003 Rowe
6,652,378 B2 11/2003 Cannon et al.
6,656,048 B2 12/2003 Olsen
6,663,490 B2 12/2003 Soltys et al.
6,675,152 B1 1/2004 Prasad et al.
6,676,522 B2 1/2004 Rowe et al.
6,682,421 B1 1/2004 Rowe et al.
6,682,423 B2 1/2004 Brosnan et al.
6,685,564 B2 2/2004 Oliver
6,685,567 B2 2/2004 Cockerille et al.
6,688,979 B2 2/2004 Soltys et al.
6,699,128 B1 3/2004 Beadell et al.
6,702,291 B2 3/2004 Grebler et al.
6,712,695 B2 3/2004 Mothwurf et al.
6,712,696 B2 3/2004 Soltys et al.
6,712,702 B2 3/2004 Goldberg et al.
6,718,361 B1 4/2004 Basani et al.
6,722,985 B2 4/2004 Criss-Puszkiewicz et al.
6,728,740 B2 4/2004 Kelly et al.
6,743,102 B1 6/2004 Fiechter et al.
6,746,330 B2 6/2004 Cannon
6,749,510 B2 6/2004 Giobbi

(56) References Cited

U.S. PATENT DOCUMENTS 6,752,312 B1 6/2004 Chamberlain et al.
6,755,741 B1 6/2004 Rafaeli
6,758,751 B2 7/2004 Soltys et al.
6,795,858 B1 * 9/2004 Jain et al. ..... 709/226
6,800,029 B2 10/2004 Rowe et al.
6,811,488 B2 11/2004 Paravia et al.
6,817,948 B2 11/2004 Pascal et al.
6,823,419 B2 11/2004 Berg et al.
6,837,789 B2 1/2005 Garahi et al.
6,846,238 B2 1/2005 Wells
6,848,994 B1 2/2005 Knust et al.
6,854,085 B1 2/2005 Morse
6,866,581 B2 3/2005 Martinek et al.
6,866,586 B2 3/2005 Oberberger et al.
6,884,170 B2 4/2005 Rowe
6,884,173 B2 4/2005 Gauselmann
6,884,174 B2 4/2005 Lundy et al.
6,896,618 B2 5/2005 Benoy et al.
6,899,627 B2 5/2005 Lam et al.
6,899,628 B2 5/2005 Leen et al.
6,901,440 B1 5/2005 Bimm et al.
6,905,411 B2 6/2005 Nguyen et al.
6,908,387 B2 6/2005 Hedrick et al.
6,962,530 B2 11/2005 Jackson
6,971,956 B2 12/2005 Rowe et al.
6,972,682 B2 12/2005 Lareau et al.
6,993,587 B1 1/2006 Basani et al.
6,997,803 B2 2/2006 LeMay et al.
7,013,469 B2 3/2006 Smith et al.
7,025,674 B2 4/2006 Adams et al.
7,027,996 B2 4/2006 Levinson
7,035,626 B1 4/2006 Luciano, Jr.
7,050,056 B2 5/2006 Meyringer
7,051,101 B1 5/2006 Dubrovsky et al.
7,062,470 B2 6/2006 Prasad et al.
7,086,947 B2 8/2006 Walker et al.
7,099,035 B2 8/2006 Brooks et al.
7,100,184 B1 8/2006 Kahn
7,112,138 B2 9/2006 Hedrick et al.
7,114,718 B2 10/2006 Grauzer et al.
7,116,782 B2 10/2006 Jackson et al.
7,120,879 B2 10/2006 Gutberlet et al.
7,128,652 B1 10/2006 Lavoie et al.
7,140,964 B2 11/2006 Walker et al.
7,147,558 B2 12/2006 Giobbi
7,168,089 B2 1/2007 Nguyen et al.
7,179,170 B2 2/2007 Martinek et al.
7,186,181 B2 3/2007 Rowe
7,189,161 B1 3/2007 Wiltshire et al.
7,197,765 B2 3/2007 Chan et al.
7,198,571 B2 4/2007 LeMay et al.
7,203,841 B2 4/2007 Jackson et al.
RE39,644 E 5/2007 Alcorn et al.
7,246,799 B2 7/2007 Snow
7,260,834 B1 8/2007 Carlson
7,291,068 B2 11/2007 Bryant et al.
7,293,282 B2 11/2007 Danforth et al.
7,297,062 B2 11/2007 Gatto et al.
7,300,352 B2 11/2007 Rowe
7,303,473 B2 12/2007 Rowe
7,303,475 B2 12/2007 Britt et al.
7,309,065 B2 12/2007 Yoseloff et al.
7,311,605 B2 12/2007 Moser
7,329,185 B2 2/2008 Conover et al.
7,330,822 B1 2/2008 Robson et al.
7,331,520 B2 2/2008 Silva et al.
7,337,330 B2 2/2008 Gatto et al.
7,346,682 B2 3/2008 Basani et al.
7,349,920 B1 3/2008 Feinberg et al.
7,351,147 B2 4/2008 Stockdale et al.
7,353,183 B1 4/2008 Musso
7,356,770 B1 4/2008 Jackson
7,363,342 B1 4/2008 Wang et al.
7,364,510 B2 4/2008 Walker et al.
7,370,282 B2 5/2008 Cary
7,384,339 B2 6/2008 LeMay et al.
7,398,327 B2 7/2008 Lee
7,410,422 B2 8/2008 Fine
7,419,428 B2 9/2008 Rowe
7,427,233 B2 9/2008 Walker et al.
7,427,236 B2 9/2008 Kaminkow et al.
7,434,805 B2 10/2008 Grauzer et al.
7,435,179 B1 10/2008 Ford
7,438,221 B2 10/2008 Washington et al.
7,438,295 B2 10/2008 Aida
7,438,643 B2 10/2008 Brosnan et al.
7,455,591 B2 11/2008 Nguyen
7,460,863 B2 12/2008 Steelberg et al.
7,465,231 B2 12/2008 Lewin et al.
7,473,178 B2 1/2009 Boyd et al.
7,483,394 B2 1/2009 Chang et al.
7,484,207 B2 1/2009 Sato
7,500,915 B2 3/2009 Wolf et al.
7,510,474 B2 3/2009 Carter, Sr.
7,510,478 B2 3/2009 Benbrahim et al.
7,515,718 B2 4/2009 Nguyen et al.
7,516,959 B2 4/2009 Huard et al.
7,534,169 B2 5/2009 Amaitis et al.
7,537,456 B2 5/2009 Snow
7,549,576 B2 6/2009 Alderucci et al.
7,559,080 B2 7/2009 Bhargavan et al.
7,566,274 B2 7/2009 Johnson et al.
7,575,234 B2 8/2009 Soltys et al.
7,577,847 B2 8/2009 Nguyen et al.
7,578,739 B2 8/2009 Gauselmann
7,581,256 B2 8/2009 Cockerille et al.
7,585,217 B2 9/2009 Lutnick et al.
7,594,030 B2 9/2009 Teodosiu et al.
7,607,976 B2 10/2009 Baerlocher et al.
7,607,977 B2 10/2009 Baerlocher et al.
7,610,549 B2 10/2009 Vignet
7,611,404 B1 11/2009 Hilf et al.
7,611,407 B1 11/2009 Itkis et al.
7,611,409 B2 11/2009 Muir et al.
7,617,151 B2 11/2009 Rowe
7,618,317 B2 11/2009 Jackson
7,621,809 B2 11/2009 Baerlocher et al.
7,629,886 B2 12/2009 Steeves
7,634,550 B2 12/2009 Wolber et al.
7,637,810 B2 12/2009 Amaitis et al.
7,644,861 B2 1/2010 Alderucci et al.
7,648,414 B2 1/2010 McNutt et al.
7,666,081 B2 2/2010 Baerlocher et al.
7,666,095 B2 2/2010 Van Luchene
7,674,179 B2 3/2010 Baerlocher et al.
7,682,249 B2 3/2010 Winans et al.
7,684,874 B2 3/2010 Schlottmann et al.
7,684,882 B2 3/2010 Baerlocher et al.
7,685,516 B2 3/2010 Fischer
7,685,593 B2 3/2010 Solomon et al.
7,686,688 B2 3/2010 Friedman et al.
7,688,322 B2 3/2010 Kapler et al.
7,689,302 B2 3/2010 Schlottmann et al.
7,690,995 B2 4/2010 Frankulin et al.
7,699,697 B2 4/2010 Darrah et al.
7,699,703 B2 4/2010 Muir et al.
7,702,719 B1 4/2010 Betz et al.
7,706,895 B2 4/2010 Callaghan
7,712,050 B2 5/2010 Gutberlet et al.
7,722,453 B2 5/2010 Lark et al.
7,730,198 B2 6/2010 Ruppert et al.
7,744,452 B2 6/2010 Cimring et al.
7,744,462 B2 6/2010 Grav et al.
7,747,741 B2 6/2010 Basani et al.
7,753,790 B2 7/2010 Nguyen et al.
7,769,877 B2 8/2010 McBride et al.
7,778,635 B2 8/2010 Crookham et al.
7,780,525 B2 8/2010 Walker et al.
7,780,526 B2 8/2010 Nguyen et al.
7,780,529 B2 8/2010 Rowe et al.
7,783,881 B2 8/2010 Morrow et al.
7,785,204 B2 8/2010 Wells et al.
7,787,972 B2 8/2010 Schlottmann et al.
7,788,503 B2 8/2010 Gatto et al.

(56) References Cited

U.S. PATENT DOCUMENTS 7,794,319 B2 9/2010 Luciano, Jr. et al.
7,805,719 B2 9/2010 O'Neill
7,824,255 B2 11/2010 Lutnick et al.
7,824,267 B2 11/2010 Cannon et al.
7,828,649 B2 11/2010 Cuddy et al.
7,828,661 B1 11/2010 Fish et al.
7,841,946 B2 11/2010 Walker et al.
7,844,944 B2 11/2010 Gutberlet et al.
7,846,018 B2 12/2010 Baerlocher
7,846,020 B2 12/2010 Walker et al.
7,850,528 B2 12/2010 Wells
7,857,702 B2 12/2010 Hilbert
7,862,425 B2 1/2011 Cavagna
7,867,081 B2 1/2011 Schneider et al.
7,867,091 B2 1/2011 Moshal
7,871,323 B2 1/2011 Walker et al.
7,874,920 B2 1/2011 Hornik et al.
7,874,921 B2 1/2011 Baszucki et al.
7,886,288 B2 2/2011 Breckner et al.
7,892,093 B2 2/2011 Kniesteadt et al.
7,898,679 B2 3/2011 Brack et al.
7,901,294 B2 3/2011 Walker et al.
7,905,770 B2 3/2011 Snow
7,905,780 B2 3/2011 Morrow et al.
7,908,486 B2 3/2011 Gatto et al.
7,909,689 B2 3/2011 Lardie
7,918,735 B2 4/2011 Inamura
7,921,026 B2 4/2011 O'Cull et al.
7,921,405 B2 4/2011 Gupta et al.
7,931,533 B2 4/2011 LeMay et al.
7,937,464 B2 5/2011 Ruppert et al.
7,946,911 B2 5/2011 Vang et al.
7,963,847 B2 6/2011 Baerlocher
7,980,954 B2 7/2011 Gagner et al.
7,988,554 B2 8/2011 LeMay et al.
7,993,199 B2 8/2011 Iddings et al.
8,025,574 B2 9/2011 Hilbert
8,028,046 B2 9/2011 Elliott et al.
8,033,913 B2 10/2011 Cockerille et al.
8,037,313 B2 10/2011 Hamalainen et al.
8,051,180 B2 11/2011 Mazzaferri et al.
8,057,294 B2 11/2011 Pacey et al.
8,057,297 B2 11/2011 Silvestro
8,062,134 B2 11/2011 Kelly et al.
8,070,583 B2 12/2011 Baerlocher et al.
8,073,657 B2 12/2011 Moore, III et al.
8,075,403 B2 12/2011 O'Brien et al.
8,092,289 B2 1/2012 Mai
8,092,307 B2 1/2012 Kelly
8,092,309 B2 1/2012 Bickley
8,100,753 B2 1/2012 Soltys
8,117,461 B2 2/2012 Bigelow, Jr. et al.
8,135,793 B2 3/2012 Ruppert et al.
8,147,316 B2 4/2012 Arezina et al.
8,147,334 B2 4/2012 Gatto et al.
8,171,155 B2 5/2012 Ruppert
8,172,661 B1 5/2012 Hein
8,177,634 B2 5/2012 Herrmann et al.
8,182,346 B2 5/2012 Herrmann et al.
8,185,423 B2 5/2012 Brook et al.
8,187,087 B2 5/2012 Herrmann et al.
8,187,101 B2 5/2012 Herrmann et al.
8,192,283 B2 6/2012 Ruppert et al.
8,192,289 B2 6/2012 Herrmann et al.
8,195,825 B2 6/2012 Ruppert et al.
8,195,826 B2 6/2012 Ruppert et al.
8,197,340 B2 6/2012 Garvey et al.
8,197,344 B2 6/2012 Rathsack et al.
8,201,229 B2 6/2012 Ruppert et al.
8,241,111 B2 8/2012 Manfredi et al.
8,246,466 B2 8/2012 Herrmann et al.
8,266,213 B2 9/2012 Crowder
8,272,945 B2 9/2012 Kelly et al.
8,277,324 B2 10/2012 Herrmann et al.
8,280,777 B2 10/2012 Mengerink et al.
8,285,740 B2 10/2012 Graham et al.
8,308,554 B2 11/2012 Rowe et al.
8,360,870 B2 1/2013 Herrmann et al.
8,366,550 B2 2/2013 Herrmann et al.
8,512,150 B2 8/2013 Herrmann et al.
8,628,422 B2 1/2014 Allen et al.
8,974,305 B2 3/2015 Costello et al.
2001/0019966 A1 9/2001 Idaka
2001/0044337 A1* 11/2001 Rowe et al. ..... 463/29
2002/0004824 A1 1/2002 Cuan et al.
2002/0049909 A1 4/2002 Jackson et al.
2002/0111213 A1 8/2002 McEntee et al.
2002/0113371 A1 8/2002 Snow
2002/0115487 A1 8/2002 Wells
2002/0119824 A1 8/2002 Allen
2002/0142844 A1 10/2002 Kerr
2002/0144115 A1 10/2002 Lemay et al.
2002/0147047 A1 10/2002 Letovsky et al.
2002/0151363 A1 10/2002 Letovsky et al.
2002/0152120 A1 10/2002 Howington
2003/0004871 A1 1/2003 Rowe
2003/0032474 A1 2/2003 Kaminkow
2003/0042679 A1 3/2003 Snow
2003/0064798 A1 4/2003 Grauzer et al.
2003/0075869 A1 4/2003 Breeding et al.
2003/0090064 A1 5/2003 Hoyt et al.
2003/0104865 A1 6/2003 Itkis et al.
2003/0130024 A1 7/2003 Darby
2003/0134675 A1 7/2003 Oberberger
2003/0182414 A1 9/2003 O'Neill
2003/0185229 A1 10/2003 Shachar et al.
2003/0203755 A1 10/2003 Jackson
2003/0206548 A1 11/2003 Bannai et al.
2003/0224858 A1 12/2003 Yoseloff et al.
2003/0228912 A1 12/2003 Wells et al.
2003/0232651 A1 12/2003 Huard et al.
2004/0002386 A1 1/2004 Wolfe et al.
2004/0002388 A1 1/2004 Larsen et al.
2004/0023712 A1 2/2004 Oliver
2004/0029635 A1 2/2004 Giobbi
2004/0043815 A1 3/2004 Kaminkow
2004/0043820 A1 3/2004 Schlottmann
2004/0048669 A1 3/2004 Rowe
2004/0048671 A1 3/2004 Rowe
2004/0064817 A1 4/2004 Shibayama et al.
2004/0082385 A1 4/2004 Silva et al.
2004/0092310 A1 5/2004 Brosnan et al.
2004/0106452 A1 6/2004 Nguyen et al.
2004/0110119 A1 6/2004 Riconda et al.
2004/0127291 A1 7/2004 George et al.
2004/0133485 A1 7/2004 Schoonmaker et al.
2004/0142744 A1 7/2004 Atkinson et al.
2004/0166940 A1 8/2004 Rothschild
2004/0180722 A1 9/2004 Giobbi
2004/0185936 A1 9/2004 Block et al.
2004/0204231 A1 10/2004 Martin et al.
2004/0229684 A1 11/2004 Blackburn et al.
2004/0254993 A1 12/2004 Mamas
2004/0259640 A1* 12/2004 Gentles et al. ..... 463/42
2005/0032564 A1 2/2005 Sines
2005/0043094 A1 2/2005 Nguyen et al.
2005/0054438 A1 3/2005 Rothschild et al.
2005/0070358 A1 3/2005 Angell et al.
2005/0080898 A1 4/2005 Block
2005/0119052 A1 6/2005 Russell et al.
2005/0143166 A1 6/2005 Walker et al.
2005/0153778 A1 7/2005 Nelson et al.
2005/0164762 A1 7/2005 Smith et al.
2005/0171808 A1 8/2005 Saenz et al.
2005/0192092 A1 9/2005 Breckner et al.
2005/0222891 A1 10/2005 Chan et al.
2005/0239542 A1 10/2005 Olsen
2006/0003828 A1 1/2006 Abecassis
2006/0004618 A1 1/2006 Brixius
2006/0009282 A1 1/2006 George et al.
2006/0015716 A1 1/2006 Thornton et al.
2006/0026499 A1 2/2006 Weddle
2006/0031763 A1 2/2006 Yeung
2006/0035707 A1 2/2006 Nguyen et al.

(56) References Cited

U.S. PATENT DOCUMENTS

2006/0040745 A1 2/2006 Wells et al.
2006/0046849 A1 3/2006 Kovacs
2006/0052169 A1 3/2006 Britt et al.
2006/0068899 A1 3/2006 White et al.
2006/0080175 A1* 4/2006 Rowe et al. ..... 705/14
2006/0116208 A1 6/2006 Chen et al.
2006/0121970 A1 6/2006 Khal
2006/0172804 A1 8/2006 Acres et al.
2006/0183541 A1 8/2006 Okada et al.
2006/0189381 A1 8/2006 Daniel et al.
2006/0195847 A1 8/2006 Amano et al.
2006/0205508 A1 9/2006 Green
2006/0217202 A1 9/2006 Burke et al.
2006/0247013 A1 11/2006 Walker et al.
2006/0247057 A1 11/2006 Green et al.
2006/0252530 A1 11/2006 Oberberger et al.
2006/0253702 A1 11/2006 Lowell et al.
2006/0259604 A1 11/2006 Kotchavi et al.
2006/0277487 A1 12/2006 Poulsen et al.
2006/0284376 A1 12/2006 Snow
2006/0287098 A1 12/2006 Morrow et al.
2007/0004501 A1 1/2007 Brewer et al.
2007/0015583 A1 1/2007 Tran
2007/0026923 A1 2/2007 Muir
2007/0026935 A1 2/2007 Wolf et al.
2007/0026942 A1 2/2007 Kinsley et al.
2007/0032288 A1 2/2007 Nelson et al.
2007/0033247 A1 2/2007 Martin
2007/0054740 A1 3/2007 Salls et al.
2007/0055753 A1 3/2007 Robb
2007/0057453 A1 3/2007 Soltys et al.
2007/0057454 A1 3/2007 Fleckenstein
2007/0057469 A1 3/2007 Grauzer et al.
2007/0060225 A1 3/2007 Hosogai et al.
2007/0060259 A1 3/2007 Pececnik
2007/0060307 A1 3/2007 Mathis et al.
2007/0060320 A1 3/2007 Kelly et al.
2007/0060354 A1 3/2007 Themer et al.
2007/0060365 A1 3/2007 Tien et al.
2007/0072677 A1 3/2007 Lavoie et al.
2007/0077995 A1 4/2007 Oak et al.
2007/0093298 A1 4/2007 Brunet
2007/0105628 A1 5/2007 Arbogast et al.
2007/0111775 A1 5/2007 Yoseloff
2007/0111786 A1 5/2007 Snow
2007/0111791 A1 5/2007 Arbogast et al.
2007/0111794 A1 5/2007 Hogan et al.
2007/0117608 A1 5/2007 Roper et al.
2007/0118844 A1 5/2007 Huang et al.
2007/0123346 A1 5/2007 Perez et al.
2007/0124483 A1 5/2007 Marples et al.
2007/0129141 A1* 6/2007 Walker et al. ..... 463/25
2007/0129145 A1 6/2007 Blackburn et al.
2007/0155490 A1 7/2007 Phillips et al.
2007/0167235 A1 7/2007 Naicker
2007/0173331 A1* 7/2007 Crawford et al. ..... 463/42
2007/0184905 A1 8/2007 Gatto et al.
2007/0191102 A1 8/2007 Coliz et al.
2007/0192748 A1 8/2007 Martin et al.
2007/0197294 A1 8/2007 Gong
2007/0197298 A1 8/2007 Rowe
2007/0198418 A1 8/2007 MacDonald et al.
2007/0202941 A1 8/2007 Miltenberger et al.
2007/0208816 A1 9/2007 Baldwin et al.
2007/0213116 A1 9/2007 Crawford et al.
2007/0214030 A1 9/2007 Shear et al.
2007/0214058 A1 9/2007 Rouhi
2007/0218998 A1 9/2007 Arbogast et al.
2007/0225061 A1 9/2007 Naobayashi
2007/0235521 A1 10/2007 Mateen et al.
2007/0238526 A1 10/2007 Chandranmenon
2007/0241497 A1 10/2007 Soltys et al.
2007/0241498 A1 10/2007 Soltys
2007/0243925 A1 10/2007 LeMay et al.
2007/0243927 A1 10/2007 Soltys
2007/0243935 A1 10/2007 Huizinga
2007/0259709 A1 11/2007 Kelly et al.
2007/0259711 A1 11/2007 Thomas
2007/0265092 A1 11/2007 Betteridge
2007/0298868 A1 12/2007 Soltys
2008/0004108 A1 1/2008 Klinkhammer
2008/0009344 A1 1/2008 Graham et al.
2008/0026832 A1 1/2008 Stevens et al.
2008/0026848 A1 1/2008 Byng
2008/0032763 A1 2/2008 Giobbi
2008/0038035 A1 2/2008 Shuldman et al.
2008/0039192 A1 2/2008 Laut
2008/0039208 A1 2/2008 Abrink et al.
2008/0045341 A1 2/2008 Englman
2008/0045342 A1 2/2008 Crowder et al.
2008/0058105 A1 3/2008 Combs et al.
2008/0064501 A1 3/2008 Patel
2008/0065590 A1 3/2008 Castro et al.
2008/0073840 A1 3/2008 Comeau
2008/0076572 A1 3/2008 Nguyen et al.
2008/0090651 A1 4/2008 Baerlocher
2008/0096656 A1 4/2008 LeMay et al.
2008/0096659 A1 4/2008 Kreloff et al.
2008/0102919 A1 5/2008 Rowe et al.
2008/0102932 A1 5/2008 Anderson et al.
2008/0108405 A1 5/2008 Brosnan et al.
2008/0108433 A1 5/2008 DiMichele et al.
2008/0113764 A1 5/2008 Soltys
2008/0113772 A1 5/2008 Burrill et al.
2008/0113773 A1 5/2008 Johnson et al.
2008/0119284 A1 5/2008 Luciano, Jr. et al.
2008/0126803 A1 5/2008 Ginter et al.
2008/0127174 A1 5/2008 Johnson
2008/0136102 A1 6/2008 Hoover
2008/0138773 A1 6/2008 Lathrop
2008/0146337 A1 6/2008 Halonen et al.
2008/0153599 A1 6/2008 Atashband
2008/0153600 A1 6/2008 Swarna
2008/0154916 A1 6/2008 Atashband
2008/0155665 A1 6/2008 Ruppert
2008/0162729 A1 7/2008 Ruppert
2008/0165771 A1 7/2008 Gainey et al.
2008/0171588 A1 7/2008 Atashband
2008/0171598 A1 7/2008 Deng
2008/0176627 A1 7/2008 Lardie
2008/0200255 A1 8/2008 Eisele
2008/0243697 A1 10/2008 Irving et al.
2008/0244565 A1 10/2008 Levidow et al.
2008/0248875 A1 10/2008 Beatty
2008/0252011 A1 10/2008 Bickley et al.
2008/0261699 A1 10/2008 Topham et al.
2008/0261701 A1 10/2008 Lewin et al.
2008/0287197 A1 11/2008 Ruppert et al.
2008/0293494 A1 11/2008 Adiraju et al.
2008/0300046 A1 12/2008 Gagner et al.
2008/0311971 A1 12/2008 Dean
2008/0313282 A1 12/2008 Warila et al.
2008/0318655 A1 12/2008 Davies
2008/0318685 A9 12/2008 Oak et al.
2009/0005176 A1 1/2009 Morrow et al.
2009/0005177 A1 1/2009 Kishi et al.
2009/0011833 A1 1/2009 Seelig et al.
2009/0054139 A1 2/2009 Anderson
2009/0063309 A1 3/2009 Stephens
2009/0069090 A1 3/2009 Moser et al.
2009/0100409 A1 4/2009 Toneguzzo
2009/0115133 A1 5/2009 Kelly et al.
2009/0118001 A1 5/2009 Kelly et al.
2009/0118005 A1 5/2009 Kelly et al.
2009/0118006 A1 5/2009 Kelly et al.
2009/0121434 A1 5/2009 Baerlocher et al.
2009/0124329 A1 5/2009 Palmisano
2009/0124385 A1 5/2009 Cuddy et al.
2009/0124392 A1 5/2009 Ruppert et al.
2009/0124394 A1 5/2009 Swarna
2009/0125603 A1 5/2009 Atashband et al.
2009/0131144 A1 5/2009 Allen
2009/0131163 A1 5/2009 Arbogast et al.
2009/0132720 A1 5/2009 Ruppert et al.

(56) References Cited

U.S. PATENT DOCUMENTS

| | | | |
|---|---|---|---|
| 2009/0156310 | A1 | 6/2009 | Fargo |
| 2009/0156313 | A1 | 6/2009 | Blackburn et al. |
| 2009/0170594 | A1 | 7/2009 | Delaney et al. |
| 2009/0176578 | A1 | 7/2009 | Herrmann et al. |
| 2009/0181776 | A1 | 7/2009 | Deng |
| 2009/0239667 | A1 | 9/2009 | Rowe et al. |
| 2009/0270170 | A1 | 10/2009 | Patton |
| 2009/0275394 | A1 | 11/2009 | Young et al. |
| 2009/0275400 | A1 | 11/2009 | Rehm et al. |
| 2009/0275401 | A1 | 11/2009 | Allen et al. |
| 2009/0275402 | A1 | 11/2009 | Backover et al. |
| 2009/0276341 | A1 | 11/2009 | McMahan et al. |
| 2009/0298575 | A1 | 12/2009 | Hopkins et al. |
| 2009/0298577 | A1 | 12/2009 | Gagner et al. |
| 2009/0298583 | A1 | 12/2009 | Jones |
| 2009/0307069 | A1 | 12/2009 | Meyerhofer |
| 2009/0315264 | A1 | 12/2009 | Snow et al. |
| 2009/0325708 | A9 | 12/2009 | Kerr |
| 2009/0325716 | A1 | 12/2009 | Harari |
| 2010/0016050 | A1 | 1/2010 | Snow et al. |
| 2010/0016067 | A1 | 1/2010 | White et al. |
| 2010/0016068 | A1 | 1/2010 | White et al. |
| 2010/0048291 | A1 | 2/2010 | Warkentin |
| 2010/0048304 | A1 | 2/2010 | Boesen |
| 2010/0058320 | A1 | 3/2010 | Milligan et al. |
| 2010/0062835 | A1 | 3/2010 | Hopkins |
| 2010/0062838 | A1 | 3/2010 | Nguyen et al. |
| 2010/0069155 | A1 | 3/2010 | Schwartz et al. |
| 2010/0093440 | A1 | 4/2010 | Burke |
| 2010/0093441 | A1 | 4/2010 | Rajaraman et al. |
| 2010/0125851 | A1 | 5/2010 | Singh et al. |
| 2010/0131772 | A1 | 5/2010 | Atashband et al. |
| 2010/0178987 | A1 | 7/2010 | Pacey |
| 2010/0197410 | A1 | 8/2010 | Leen et al. |
| 2010/0210353 | A1 | 8/2010 | Gagner et al. |
| 2010/0234110 | A1 | 9/2010 | Clarkson |
| 2010/0240440 | A1 | 9/2010 | Szrek et al. |
| 2010/0255899 | A1 | 10/2010 | Paulsen |
| 2011/0009184 | A1 | 1/2011 | Byng |
| 2011/0074107 | A1 | 3/2011 | Rowe |
| 2011/0105208 | A1 | 5/2011 | Bickley |
| 2011/0111826 | A1 | 5/2011 | Baerlocher et al. |
| 2011/0124417 | A1 | 5/2011 | Baynes et al. |
| 2011/0130190 | A1 | 6/2011 | Hamman et al. |
| 2011/0159952 | A1 | 6/2011 | Kerr |
| 2011/0159953 | A1 | 6/2011 | Kerr |
| 2011/0165936 | A1 | 7/2011 | Kerr |
| 2011/0172008 | A1 | 7/2011 | Alderucci |
| 2011/0179409 | A1 | 7/2011 | Yoseloff et al. |
| 2011/0183748 | A1 | 7/2011 | Wilson et al. |
| 2011/0230268 | A1 | 9/2011 | Williams |
| 2011/0269529 | A1 | 11/2011 | Baerlocher |
| 2011/0269534 | A1 | 11/2011 | Kelly et al. |
| 2011/0275430 | A1 | 11/2011 | Walker et al. |
| 2011/0287829 | A1 | 11/2011 | Clarkson et al. |
| 2012/0015724 | A1 | 1/2012 | Ocko et al. |
| 2012/0015725 | A1 | 1/2012 | Ocko et al. |
| 2012/0015743 | A1 | 1/2012 | Lam et al. |
| 2012/0015747 | A1 | 1/2012 | Ocko et al. |
| 2012/0021835 | A1 | 1/2012 | Keller et al. |
| 2012/0034977 | A1 | 2/2012 | Kammler |
| 2012/0110649 | A1 | 5/2012 | Murphy |
| 2012/0115616 | A1 | 5/2012 | Phillips et al. |
| 2012/0203692 | A1 | 8/2012 | Olliphant et al. |
| 2012/0295691 | A1 | 11/2012 | Walker |
| 2013/0053117 | A1 | 2/2013 | Snow |
| 2013/0184060 | A1 | 7/2013 | Costello et al. |

FOREIGN PATENT DOCUMENTS

| | | | |
|---|---|---|---|
| EP | 1074955 | A2 | 2/2001 |
| EP | 1463008 | A2 | 9/2004 |
| GB | 2380143 | A | 4/2003 |
| JP | 8255059 | | 10/1996 |
| KR | 2001-0084838 | | 9/2001 |
| KR | 2002-0061793 | | 7/2002 |
| KR | 2003-0091635 | | 12/2003 |
| WO | 02/05914 | A1 | 1/2002 |
| WO | 03/60846 | A2 | 7/2003 |
| WO | 2005/035084 | | 4/2005 |
| WO | 2007/033207 | A2 | 3/2007 |
| WO | WO2007047223 | | 4/2007 |
| WO | 2011109454 | | 9/2011 |

OTHER PUBLICATIONS

International Search Report and Written Opinion for co-pending application PCT/US13/22153, dated Apr. 8, 2013.

United States Office Action, U.S. Appl. No. 13/624,743, Jan. 29, 2013, 7 pages.

U.S. Appl. No. 13/860,991, filed Apr. 11, 2013, and titled "Interactive Financial Transactions," to Andrew Costello.

U.S. Appl. No. 13/609,031, filed Sep. 10, 2012, and titled "Network Gaming Architecture, Gaming Systems, and Related Methods," to Costello et al.

U.S. Appl. No. 13/624,743, filed Sep. 21, 2012, and titled "Play for Fun Network Gaming System and Method," to Costello et al.

U.S. Appl. No. 13/864,069, filed Apr. 16, 2013, and titled "Administering Wagering Games Having Supplemental Pot," to Louis J. Castle, II.

U.S. Appl. No. 13/871,824, filed Apr. 26, 2013, and titled "Distributing Supplemental Pot in Wagering Games Based on Predetermined Event," to Castle et al.

"BOB and LDAP," Gaming Standards Association, Fremont, California, 7 pages, Oct. 26, 2003.

"GSA Point-to-Point SOAP/HTTPS Transport and Security Specification v1.0.3," Gaming Standards Association TRANSPORT Technical Committee, 16 pages, Jun. 5, 2007.

Bally Technologies, Inc., iVIEW, http://ballytech.com/systems/product.cfm?id=9, download date Nov. 6, 2007, 2 pages.

Bally TMS, "MP21—Automated Table Tracking/Features," 2 pages, Nov. 2005.

Bally TMS, "MPBacc—Specifications/Specifications," 2 pages, Nov. 2005.

Bally TMS, "MPLite—Table Management System/Features," 2 pages, Nov. 2005.

Bulavsky, J., "Tracking the Tables," Casino Journal, May 2004, pp. 44-47, accessed Dec. 21, 2005, URL = http://www.ascendgaming.com/cj/vendors_manufacturers_table/Trackin916200411141AM.htm, 5 pages.

Burke, A., "Tracking the Tables," reprinted from *International Gaming & Wagering Business*, Aug. 2003, 4 pages.

Costello et al., "Network Gaming Architecture, Gaming Systems, and Related Methods," Office Action mailed Mar. 27, 2014, for U.S. Appl. No. 13/609,031, 11 pages.

Costello et al., "Network Gaming Architecture, Gaming Systems, and Related Methods," Amendment dated Jul. 25, 2014, for U.S. Appl. No. 13/609,031, 12 pages.

Costello et al., "Network Gaming Architecture, Gaming Systems, and Related Methods," Notice of Allowance mailed Nov. 3, 2014, for U.S. Appl. No. 13/609,031, 7 pages.

Costello et al., "Play for Fun Network Gaming System and Method," Office Action mailed Jan. 29, 2013, for U.S. Appl. No. 13/624,743, 7 pages.

Costello et al., "Play for Fun Network Gaming System and Method," Amendment dated Apr. 29, 2013, for U.S. Appl. No. 13/624,743, 12 pages.

Costello et al., "Play for Fun Network Gaming System and Method," Office Action mailed Nov. 12, 2013, for U.S. Appl. No. 13/624,743, 15 pages.

Costello et al., "Play for Fun Network Gaming System and Method," Amendment dated Jan. 13, 2014, for U.S. Appl. No. 13/624,743, 9 pages.

(56) References Cited

OTHER PUBLICATIONS

Costello et al., "Play for Fun Network Gaming System and Method," Advisory Action mailed Feb. 25, 2014, for U.S. Appl. No. 13/624,743, 5 pages.
Costello et al., "Play for Fun Network Gaming System and Method," Amendment dated Apr. 14, 2014, for U.S. Appl. No. 13/624,743, 10 pages.
Costello et al., "Play for Fun Network Gaming System and Method," Office Action mailed Jan. 30, 2015, for U.S. Appl. No. 13/624,743, 14 pages.
Gros, R., "All You Ever Wanted to Know About Table Games," reprinted from *Global Gaming Business*, Aug. 1, 2003, 2 pages.
Gwyddion User Guide, "False Color Mapping: Chapter 3. Getting Started," retrieved from URL=http://sourceforge.net/projects/gwyddion/files/user-guide/2007-06-28/gwyddion-user-guide-xhtm1-2007-06-28.tar.gz/download, retrieved on Nov. 21, 2012, 2 pages.
Hung et al., "Performance Evaluation of the Least Conflict Sharable Spreading Code Assignment Algorithm," IEEE, 1996, 5 pages.
MagTek, "Port Powered Swipe Reader," Technical Reference Manual, Manual Part No. 99875094 Rev 12, Jun. 2003, 20 pages.
Mikohn, "Mikohn Tablelink—The Industry's Premier Table Tracking Solution Delivers Improvements Straight to the Bottom Line," 2 pages, before Jan. 1, 2004.
Olesiejuk, "Discovery Services for Gaming Devices on a Casino Floor," Gaming Standards Association, 3 pages, Mar. 12, 2007.
Requirements document, "Game Authentication Terminal Program (GAT3)," to Gaming Standards Association, Aug. 2005, 27 pages.
Standards document, "Technical Standards for Gaming Devices and On-Line Slot Systems," to Nevada Gaming Commission and State Gaming Control Board, Aug. 17, 2005, 15 pages.
Terdiman, D., "Who's Holding the Aces Now?", reprinted from *Wired News*, Aug. 18, 2003, 2 pages.
Winkler, C., "Product Spotlight: MindPlay," reprinted from *Gaming and Leisure Technology*, Fall 2003, 2 pages.
PCT Written Opinion of the International Preliminary Examining Authority, PCT Application No. PCT/US2013/021959, Jan. 30, 2014, 4 pages.
United States Office Action, U.S. Appl. No. 13/624,743, Nov. 12, 2013, 15 pages.
United States Office Action, U.S. Appl. No. 13/609,031, Mar. 27, 2014, 11 pages.

* cited by examiner

NETWORK GAMING ARCHITECTURE, GAMING SYSTEMS, AND RELATED METHODS

FIELD

Embodiments of the present disclosure relate generally to wagering games and, more particularly, to network gaming architectures, gaming systems, and related methods.

BACKGROUND

Global internet access has revolutionized electronic gaming, and in particular, participation in on-line gambling games and related websites offering such games. Such internet gaming platforms have enabled players to participate in gambling and other gaming events through personal computers or other electronic devices, wherever the player may be and at all times. Implementations of on-line gambling may include typical gambling elements, such as permitting one or more users to bet against the House in wagering games that are similar to those found in traditional casinos. In fact, many casinos have an on-line presence and offer on-line gambling operations. Such on-line gambling operations generally enable users to choose a wagering game, enter the wagering game by either downloading a computer application or through a web browser, place bets on one or more possible outcomes of the game, and win or lose money according to the outcome of the bets. With most on-line gambling applications, the House controls the computer application or web site through which a player bets. The House is generally in control of both managing the game and all associated financial transactions.

It is not surprising that security of such on-line gambling platforms is of utmost importance. Hackers may attempt to cheat and gain an unfair advantage in a variety of ways that would cause the House to lose significant sums of money by paying on bets that should not have been paid on, by allowing bets to be placed when the game outcome can be already be determined by unauthorized access, or by redirecting payments to parties that are not entitled to such payments. For example, a hacker may attempt to gain unauthorized access to view and in some cases even alter game information. In addition, individuals employed to work on the on-line gaming platform may be tempted to use their access to cheat the system.

Another consideration of on-line gambling platforms is that considerable resources are used in complying with regulatory requirements and in meeting increasing player demand. The inventors have appreciated the need for improved network gaming architectures, systems, and related methods to address various deficiencies of conventional approaches.

DETAILED DESCRIPTION

Figure 1A:
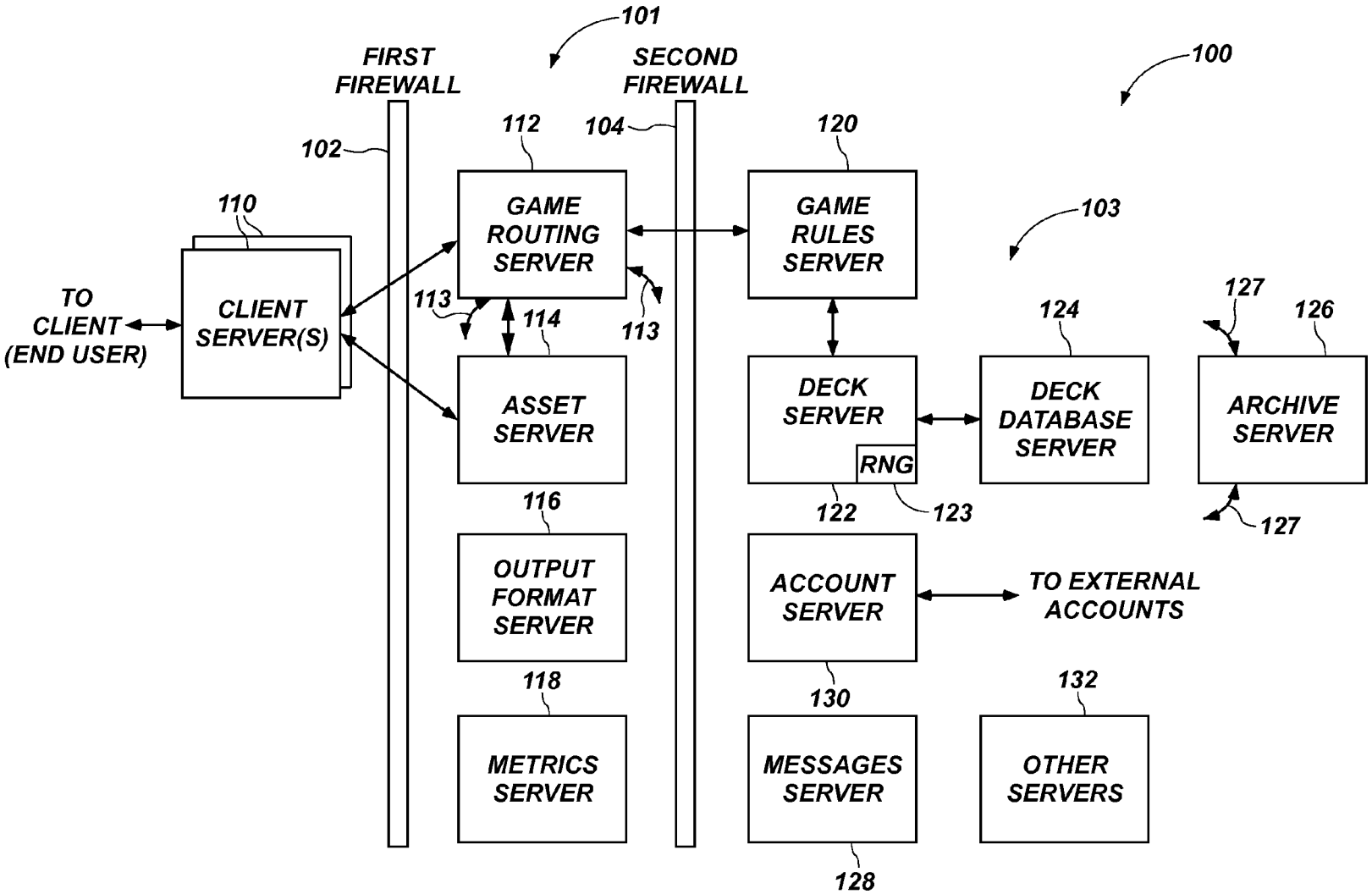
FIG. 1A is a schematic block diagram of a gaming system according to an embodiment of the present disclosure.

In the following description, reference is made to the accompanying drawings in which is shown, by way of illustration, specific embodiments of the present disclosure. The embodiments are intended to describe aspects of the disclosure in sufficient detail to enable those skilled in the art to practice that which is claimed. Other embodiments may be utilized and changes may be made without departing from the scope of the disclosure. The following detailed description is not to be taken in a limiting sense, and the scope of the present invention is defined only by the appended claims.

Furthermore, specific implementations shown and described are only examples and should not be construed as the only way to implement or partition the embodiments of the present disclosure into functional elements unless specified otherwise herein. It will be readily apparent to one of ordinary skill in the art that the various embodiments of the present disclosure may be practiced by numerous other partitioning solutions.

In the following description, elements, circuits, and functions may be shown in block diagram form in order not to obscure the present disclosure in unnecessary detail. Additionally, block definitions and partitioning of logic between various blocks is exemplary of a specific implementation. It will be readily apparent to one of ordinary skill in the art that the present disclosure may be practiced by numerous other partitioning solutions. Those of ordinary skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, wherein the bus may have a variety of bit widths and the present disclosure may be implemented on any number of data signals including a single data signal.

The various illustrative logical blocks, modules, and circuits described in connection with the embodiments disclosed herein may be implemented or performed with a general-purpose processor, a special-purpose processor, an embedded processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A general-purpose processor may be considered a special-purpose processor while the general-purpose processor executes instructions (e.g., software code) stored on a computer-readable medium. A processor may also be implemented as a combination of computing devices, such as a combination of a DSP and a microprocessor, a plurality of microprocessors, one or more microprocessors in conjunction with a DSP core, or any other such configuration.

Also, it is noted that the embodiments may be described in terms of a process that may be depicted as a flowchart, a flow diagram, a structure diagram, or a block diagram. Although a process may describe operational acts as a sequential process, many of these acts can be performed in another sequence, in parallel, or substantially concurrently. In addition, the order of the acts may be re-arranged. A process may correspond to a method, a function, a procedure, a subroutine, a subprogram, etc. Furthermore, the methods disclosed herein may be implemented in hardware, software, or both. If implemented in software, the functions may be stored or transmitted as one or more instructions or code on computer readable media. Computer-readable media includes both computer storage media and communication media, including any medium that facilitates transfer of a computer program from one place to another.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed or that the first element must precede the second element in some manner. In addition, unless stated otherwise, a set of elements may comprise one or more elements.

The terms "gaming," "gambling," or the like, refer to activities, games, sessions, rounds, hands, rolls, operations, and other events related to wagering games such as web games, casino games, card games, dice games, and other games of chance for which wagers may be placed by a player. In addition, the word "wager," "bet," "bid" or the like, refer to any type of wagers, bets or gaming ventures that are placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that are play for pay as well as play for fun, as will be described in more detail below.

Embodiments of the present disclosure include a network architecture for a gaming system that provides end users access to proprietary game content through client servers. Although the examples below generally describe a gaming system that may be used for administering card games (e.g., Hold 'Em poker variants, pai gow poker, blackjack, etc.), the gaming system may be configured to administer other types of wagering games such as dice games, big wheel games, roulette, scratch off games, and any other wagering game that uses a fixed set of game pieces for a particular round or cycle of the game and randomly selects game pieces to determine the game outcome. The use of card games as examples of wagering games is done for simplicity of the description, and not as a limitation. Modification of the gaming system to support non card-based games, or other card-based games that are not specifically described herein, is considered to be within the scope of this disclosure, as such will be apparent to those of ordinary skill in the art, given the present disclosure.

Embodiments of the present disclosure may include traditional gambling games in which money or other items of value may be cashed out at the end of a game session. In addition, embodiments of the present disclosure may include "play for fun" wagering games, in which credits (or other symbols) may be issued to a player to be used for the wagers. For example, credits may be purchased by a player or issued through other methods. While credits may be won or lost, the ability of the player to cash out the credits may be restricted or prevented. In other words, while the credits may be purchased, the credits in a play for fun embodiment may be non-monetary credits in terms of the ability of the play to cash out of the wagering game. Exemplary systems that operate play for fun games may issue free credits. In some embodiments, a limited number free credits may be issued in order to entice players to play the games. Credits may be won or lost, but credit balances may not be cashed out. In exchange for identifying friends who may want to play, the system may issue additional credits. Often, additional credits may be issued after a period of time has elapsed to encourage the player to resume playing the game. The system may enable players to buy friends or additional game credits to allow the player to resume play for fun play. However, neither credits earned nor credits remaining may be cashed in exchange for something of monetary value. It is contemplated that objects of value may be awarded to play for fun players, but not in a direct exchange for credits. For example, the client may award a prize for a highest scoring play for fun player during a defined time interval. Enabling players to buy fake friends, extra credits, and/or game pieces that allow the player to advance through the game levels with more speed may provide an additional source of revenue to the host of the gaming system.

Embodiments of the present disclosure may include wagering games in which a single player is present at a virtual table competing against the house, while other embodiments include wagering games in which multiple players are present at the virtual table competing against the house, each other, or a combination thereof. Therefore, while examples provided herein describe a player or a user, the singular use of such terms should not be interpreted to preclude embodiments in which multiple players may access one or more client servers to access the gaming system.

FIG. 1A is a schematic block diagram of a gaming system 100 according to an embodiment of the present disclosure. The gaming system 100 includes a gaming platform that establishes a portal for an end user (not shown) to access a wagering game through a client server 110. The portal enables the gaming system 100 to control game graphics, game play methods, and game play outcomes displayed on the end user's computer. The client server 110 may be configured to communicate with the gaming system 100 through the first firewall 102. In some embodiments, a single client server 110 may be provided to communicate with the gaming system 100, while other embodiments may include a plurality of client servers 110 configured to communicate and provide end users with access to the same gaming system 100. In addition, a plurality of end users may access a single client server 110 or a plurality of client servers 110.

In some embodiments, the client server 110 may not be part of the gaming system 100, in that the client server 110 may be operated by a different administrator than operates the other servers of the gaming system 100. In other words, the client server 110 may be part of a third-party system that does not administer the gaming system 100. For example, a gaming entity (e.g., a casino) may operate the client server 110 to provide its customers access to game content managed by a different entity. In some embodiments, the client server 110 may offer and/or provide access to content in addition to what is supported by the gaming system 100. As a result, the client server 110 may establish communication between the client and the gaming system 100, as well as the client and other content that is unrelated to the gaming system 100, including multiple different gaming systems that are not part of the gaming system 100. For example, a gaming entity may have a client server 110 that accesses game content from a plurality of different game administrators that provide access to different gaming systems (not shown).

It is also contemplated that in some embodiments, the client server 110 may be part of the gaming system 100, such as being operated by the same administrator as the gaming system 100. In addition, the client server 110 may be dedicated to access only game content that is supported by the gaming system 100. For example, a gaming entity (e.g., a casino) may elect to perform each of these functions in-house, such as providing both the access to the client server 110 and the actual game content and the organization, as well as providing administration of the other servers of the gaming system 100 as well.

The gaming system 100 includes a game routing server 112, an asset server 114, an output format server 116, a metrics server 118, a game rules server 120, a deck server 122, a deck database server 124, an archive server 126, a messages server 128, and an account server 130. Other servers 132 are also contemplated as being included within the gaming system 100. The various servers of the gaming system 100 may be configured to perform the described functions and communicate with each other in the manner that is described in more detail below. In addition, the various servers of the gaming system 100 may be organized in a plurality of different sub-systems that may group the servers according to similar levels of communication and security.

The gaming system 100 may include a first sub-system 101 and a second sub-system 103, such that the various servers may be organized and separated to communicate through a plurality of firewalls 102, 104. The first sub-system 101 may be configured to communicate with the client server 110 through the first firewall 102. For example, the first sub-system 101 may include the game routing server 112, the asset server 114, the output format server 116, and the metrics server 118. The second sub-system 103 may be configured to communicate with the first sub-system 101 through the second firewall 104. The second sub-system 103 may include the game rules server 120, the deck server 122, the deck database server 124, the archive server 126, the account server 130, the messages server 128, as well as one or more other servers 132. In other words, the first firewall 102 separates the client server 110 from the game routing server 112, the asset server 114, the output format server 116, and the metrics server 118.

The second sub-system 103 may be isolated from the client server 110 by the first sub-system 101. As a result, therefore, the client server 110 and the servers of the second sub-system 103 may be configured to communicate with each other only through the first sub-system 101 (and the first firewall 102 and/or second firewall 104, if provided). In other words, the second firewall 104 may further separate the game rules server 120, deck server 122, the deck database server 124, the archive server 126, the messages server 128, the account server 130, as well as other servers 132.

The various servers may be organized with respect to the first firewall 102 and the second firewall 104 in a variety of different combinations according to the different levels of security desired for each server. In other words, the specific organization of the servers with respect to the plurality of firewalls 102, 104 should not be viewed as limiting the scope of present disclosure unless specifically described as such. In addition, the gaming system 100 may include additional sub-systems (not shown) separated by additional firewalls (not shown). For example, a third sub-system, if provided, may be configured to communicate with the second sub-system 103 and this communication may be through a third firewall. In some embodiments, the third sub-system may include external accounts servers (not shown). In addition, more or fewer firewalls may be implemented.

As will be understood, therefore, the first sub-system 101 provides an interface (e.g., a gateway) through which the second sub-system 103 and optionally the third sub-system may communicate with the client server 110. The third sub-system is not shown in FIG. 1A; however, an example of such is shown as third sub-system 105 in FIG. 1B. The first sub-system 101 is configured to format information received from the second sub-system 103 and optionally the third sub-system (FIG. 1B) so that the information is in an appropriate format for reading and/or display by the client server 110. Similarly, the first sub-system 101 is configured to receive requests and information from the client server 110 and convert the requests and information into an appropriate format for processing by the second sub-system 103. Moreover, the first sub-system 101 (e.g., via game routing server 112) may perform a routing function such that requests and information from the client server 110 are routed to the appropriate components of the first sub-system 101 and the second sub-system 103.

The gaming system 100 provides gaming content and enables secure on-line gaming from the client server 110. In some embodiments, the gaming system 100 does not take wagers or issue payouts. In other words, the gaming system 100 may facilitate on-line casino gaming, but may not be an on-line casino itself. Instead, the gaming system 100 facilitates the play of proprietary card game content owned and controlled by a company offering games and gaming products and services, such as Shuffle Master, Inc. In such an embodiment, the client server 110 may interface with an end user through a web page, an application (e.g., a smartphone or tablet application such as those), or other computer program in order to access the gaming system 100. The client server 110 may be operated by a third party, such as a casino, that links to the gaming system 100 through the client server 110 via a network, such as the internet. As will be described in further detail below, the account server 130 may communicate with an external entity (e.g., a casino) that maintains end user accounts to take bets and make payout distributions. In such an embodiment, the gaming system 100 merely verifies the existence of funds for wagering, and instructs the external end user accounts to execute debits and credits. In some embodiments, the gaming system 100 may take bets and make payout distributions, such as in the case where administrator of the gaming system 100 operates as a casino. As discussed above, the gaming system 100 may be integrated within the operations of a casino rather than separating out functionality (e.g., game content, game play, credits, debits, etc.) among different entities. In addition, for "play for fun" wagering games, the gaming system 100 may issue credits, take bets, manage the balance of the credits according to the game outcomes, but may not permit payout distributions or be linked to play for fun client servers 110 that permit payout distributions. Such credits may be issued for free, through purchase, or for other reasons, without the ability for the player to cash out. Such play for fun wagering games may be played on platforms that do not permit traditional gambling, such as to comply with jurisdictions that do not permit on-line gambling.

The client server 110 may be provided with a relatively small amount of script 111 (FIG. 1B) (e.g., JavaScript), also referred to as a "script driver," including scripting language that controls the interfacing of the client server 110 with the gaming system 100. For example, the script driver may be installed in the client server 110 upon a third party entering into an agreement with the administrator of the gaming system 100 to participate in the use of the gaming system 100. In addition, the script driver may control the graphics displayed on the client server 110 when an end user (i.e., a player) selects the desired wagering game regardless of the type of device used to provide access to the games loaded onto the gaming system 100. In other words, the client server 110 essentially becomes a thin client when the player selects a wagering game to play, and the client server 110 provides the client with the ability to communicate with the game routing server 112, the asset server 114, and the output format server 116.

The game routing server 112 is configured to communicate between the client server 110 and the other various servers of the gaming system 100. The game routing server 112 may be further configured to only permit external communication through the first firewall 102 to come from the client server 110. In other words, authorized client servers 110 may be the only outside servers that are authorized (e.g., white listed) through the first firewall 102 to communicate with the game routing server 112. In addition, the client server 110 may not be permitted to communicate directly with any of the other servers of the gaming system 100 other than the game routing server 112 or, in some cases, the asset server 114.

A primary function of game routing server 112 is to route game outcome information to the client server 110 via the first firewall 102 and to further communicate with the other servers of the gaming system 100. In other words, when the client communicates with the client server 110, the client server 110 communicates with the other servers of the gaming system 100 through the game routing server 112. At times, the client server 110 may communicate directly with the asset server 114 as will be described with more detail below. Although direct communication paths are shown in FIG. 1A between the game routing server 112 and the game rules server 120 only, the game routing server 112 may nevertheless have direct communication paths established between the other servers of the gaming system 100 as indicated by arrows 113. For example, the game routing server 112 may also have direct communication paths established with the asset server 114, the output format server 116, the metrics server 118, the messages server 128, the account server 130, and other servers 132. In some embodiments, the game routing server 112 may communicate with the deck database server 124 and the archive server 126. In some embodiments, the game routing server 112 may communicate with the deck server 122 through the game rules server 120 only. This limited access to the deck server 122 may be for security reasons, to limit those who have access to deck information, and will be described more fully below. The communication links between servers will be discussed further below with respect to FIG. 1B describing the data flow and access permissions between the various servers of the gaming system 100B.

Referring still to FIG. 1A generally, the game routing server 112 directs data flow between client server 110 and the servers of the gaming system 100. The game routing server 112 may perform a relatively low amount of processing itself, and may simply route data to the appropriate location. As a result, the game routing server 112 may be inexpensive, such as from a computational standpoint, relative to some of the other servers of the gaming system 100. The main processing of the gaming system 100 may occur in the game engine, which may include the game rules server 120, and the deck server 122. Some processing of the gaming system 100 may also occur in the account server 130. The various other servers may also perform some processing according to the functions described below.

The game routing server 112 receives inputs into the gaming system 100 from the client server 110. For example, the client server 110 may send data indicating which wagering game is to be played, and game inputs such as player moves (e.g., bets, card requests, holds, etc.). Such inputs may be routed to the appropriate location, such as the game rules server 120 associated with the appropriate wagering game. The game routing server 112 may be scaled (e.g., the number of servers may be increased) to handle different games as new wagering games are released and supported by the gaming system 100 with the addition of additional game rules servers 120. Thus, a plurality of game rules servers 120 may share the game routing server 112. As a result, the more games that are added to the system, the more the cost per player per game may be reduced because resources will be shared among games. Also, as the number of clients and client servers 110 increase the number of game routing servers 112 may be increased. This approach of scaling individual servers according to need for that particular function is unlike that of conventional gaming systems, which tend to duplicate server resources for individual games (e.g., a Texas Hold 'Em variant, blackjack, etc.), which may result greater equipment and hosting expenses.

The game rules server 120 includes game rule information for at least one wagering game stored thereon. The game rules server 120 may be thought of as the game engine that controls the order of game play. For example, game rule information may include the game rules of a particular wagering game and the various stages of play. For example, the game rules include the number and order of cards to be dealt to various positions, such as the different player positions, common card positions, dealer card positions, whether cards may be shown, etc. The game rules may further include the relative ranking of hands in a card game (e.g., poker), whether the player hand is played against a dealer hand or against pay tables, and the pay tables themselves that are used to determine the amount of a payout award. In addition, the game rules may further include wager requirements such as whether wagers are mandatory or optional, the relative size of the wagers, the wager election choices, a comparison of the wager amounts made to table limits, and the like. Through the game rules server 120, the game rules ultimately determine whether the end user wins or loses, while the game routing server 112 determines what to do with such information.

As discussed briefly above, each wagering game supported by the gaming system 100 may have at least one different game rules server 120 associated therewith. In other words, in some embodiments, a set of game rules for any one game may be administered on the game rules server 120. For example, there may be at least one game rules server 120 for blackjack, at least one game rules server 120 for a Texas Hold 'Em variant, and so on. Each game rules server 120 may include game rules dedicated to a specific wagering game and does not comingle such information used by other games. Of course, the scale of the gaming system 100 and the complexity of the games may require a plurality of game rules servers 120 that are dedicated to a particular wagering game. In other embodiments, multiple sets of game rules are administered by the same game rules server 120. In other words, sets of game rules for a plurality of games may be administered by the same game rules server 120. For example, the same game rules server 120 may administer a set of game rules for the Texas Hold 'Em variant as well as a set of game rules for blackjack.

The deck server 122 is configured to provide the processing for generating the random game pieces (i.e., game piece indication) from a defined set of game pieces for the wagering game. For example, the deck server 122 includes a random number generator (RNG) 123 that is configured to randomly generate the game pieces in response to requests made from the game rules server 120 according to the rules of the wagering game being played by the end user. The random number generator 123 may be hardware based, software based, or a combination thereof. The term "random" also includes semi-random and pseudo-random events. The random number generator 123 employed shall pass a sufficient test of randomness. For example, The random number generator 123 may be created at a low-level programming level in order to sufficiently reduce or avoid language specific bugs. In operation, the random numbers may be appropriately seeded, and requests for numbers may not be done sequentially in order to ensure that the number pass an appropriate threshold test for randomness. The deck server 122 may compile a virtual deck of cards by indexing all the possible card values for a desired deck, and selecting at random one of those cards and placing it in a "shuffled" virtual deck. This process of card selection may be continued until all of the virtual cards have been placed in the virtual deck. The random number generator 123 may be implemented through one of a number of public domain and licensable random number generation algorithms, such as the CONVERSE Pseudorandom Number Generator (PRNG) developed by the University of Illinois at Urbana-Champaign of Champaign. Another example is the Park-Miller "minimal standard" PRNG, developed by Stephen K. Park and Keith W. Miller. Other methods are contemplated for ensuring that the random number generator generates a random number that passes the appropriate standard for randomness. In addition, it is recognized that standards for randomness may change over time, and that additional random number generators 123 may be developed for use with the gaming system 100.

The term "deck" is used because many common wagering games employ the use of playing cards, such as poker, Texas Hold 'Em variants, blackjack, among others. As discussed above, a non card-based game may be played that is supported by the gaming system 100. Thus, the term "deck" is not to be interpreted as requiring card deck information unless specifically stated to have such according to the game rules of the specific wagering game to be played. As the gaming system 100 includes an on-line gaming platform, the randomly selected game pieces may be thought of as virtual game pieces, such as virtual cards, virtual dice, virtual wheel positions, etc. Thus, the deck server 122 is configured to output a game piece indication which may comprise the identifier of a virtual card (e.g. the ten of hearts), a random number, one or more dice faces, a virtual wheel position, a number, a color, or the like, as well as combinations thereof. A "virtual shoe" may be referred to herein to describe the functionality of creating a virtual card deck and dispensing virtual cards as requested by the game rules server 120. In other words, the deck server 122 may generate a data file that represents the entire set of game pieces, and track the removal of cards delivered to the game such that the composition of the unused cards is also known at all times. This accounting function may prevent a card of a certain rank and suit from being dealt into the game so that the mathematics of the game is identical to a live card game and is not altered.

Using the example of a card-based game, the random number generator 123 may be used to generate one or more numbers that is used to select the card (or cards) from among the set of cards. One or more numbers may select the number and the suit of the cards. In other words, the deck server 122 serves the function of a virtual shoe to create the deck, and to hold and administer the card data for the wagering game. For example, such card data may include the initial number of cards in the set, the current number of cards in the set, the rank and suit of cards that have been removed from the set and dealt into the wagering game, the number of special cards such as promotional cards inserted into the set, the number of standard cards removed from the set to construct a special set (e.g., for the Spanish 21 game, Canasta, etc.), the number and color combination of hands dealt, the number of cards dealt to each player, the number of players in a round, etc. For poker variants, the set of cards is generally a standard deck of fifty-two cards having four standard suits. If desired, one or more jokers may be included. Blackjack games may be played with one or more combined decks of cards belonging to the set of cards. Common examples of blackjack games include one, two, four, six, or eight decks of cards. Baccarat is usually played with six or eight decks of cards belonging to the set. In the example of a non card-based game (e.g., roulette), the random number generator 123 may generate a number that is used according to the game rules of that wagering game. In creating the deck and administering the wagering game, or otherwise randomly generating the game pieces, the data may be encrypted and stored in the deck database server 124, as described below.

The deck server 122 and the game rules server 120 are separate and distinct servers. As a result, the card deck data is segregated from the game rules data on different servers. In addition, the deck server 122 and the game rules server 120 may be separated to have different access privileges to different sets of employees. Doing so may increase the security of the gaming system 100 as it limits the chances that a single employee has access to both sets of information associated with the game rules server 120 and the deck server 122. Separating the game rules data and the deck data into different servers further adds another level for a hacker to penetrate in order to obtain both sets of data during game play.

Data that is stored in the deck server 122 may be encrypted and is sent to the game rules server 120 in encrypted form, where it is decrypted and used by the game rules server 120. The encryption provides a higher level of security to the gaming system 100. In addition, data generated by the deck server 122 may be withheld from the game rules server 120 until such information is required for the determination of the game outcome, at certain intermediate game determinations, or at a time where it is required to make such information known to the end user.

An example of a wagering game supported by the gaming system 100 is a Hold 'Em poker variant game (also referred to as "Ultimate Texas Hold 'Em" ®) as described in U.S. patent application Ser. No. 11/156,352, filed on Jun. 17, 2005, and published as U.S. Patent Publication No. US 2006/0284376 A1, the entire disclosure of which is incorporated herein by this reference. In such an Ultimate Texas Hold 'Em game, there may be multiple rounds of betting, and multiple steps of card distribution and revelation of cards to the player. The gaming system 100 may be configured to wait to transfer intermediate game information, such as additional card rank and suit information from the deck server 122 to the game rules server 120 and/or the game routing server 112 on an as-needed basis. Additional game information may include, but is not limited to, extra wagers made, decisions to withdraw a wager, decisions to buy a card, decisions to fold, set a hand, a selection of a multiplier, a decision to participate in a bonus event, decisions to take hit cards, roll dice, spin wheels, activate a virtual shuffler to dispense more cards, exchange all or part of a hand with new cards, and any other decision that may be made during play of a wagering game and before conclusion of play.

As cards (or other game pieces) are needed, the game rules server 120 may request them. For example, the game rules server 120 may verify that the appropriate wager has been placed before requesting the next set of information. For example, after confirming an initial wager, the gaming system 100 deals an initial partial hand of cards to each player, whereupon the player may be asked to place another wager prior to receiving a full hand of cards. After receiving verification that the additional wager has been made, additional card data is provided to the game rules server 120. Thus, a game may require a first wager prior to the game routing server 112 delivering partial hand information in a card game to the game rules server 120, or to the client via the client server 110 according to the rules of the wagering game. The partial hand information may be considered intermediate game information. The game may also require information indicating a second wager has been made before delivering additional card information to complete the hand. This additional card information may also be considered intermediate game information.

Some of the intermediate game information may be withheld from the client server 110 as well as the game rules server 120 until all wagers have been completed and the withheld information is needed for the final game outcome determination. In addition, even if a person were to access (e.g., hack) the client server 110 or the game rules server 120 prior to that time, the person would not have access to that card information. As a result, cheating may be more difficult for such unauthorized users. Upon receiving confirmation that the game outcome (or an appropriate intermediate step) to be determined, the game rules server 120 may request the card information regarding the intermediate game information. Preventing the transmission of intermediate game information to the game rules server 120 prior to receiving a wager confirmation ensures that the gaming system 100 does not make a payout on a wager that was not received, and further reduces the risk of the game results being viewed and wagered upon if a person successfully hacks into the client server 110 or even the game rules server 120 for the purpose of retrieving card information or game results in advance of making a wager.

The asset server 114 includes asset data that is to be retrieved and used in the presentation of the wagering games on the client interfaces. In other words, the asset server 114 may deliver content to the client through the client server 110 related to the presentation of the wagering game. For example, asset data may include image data, audio data, video data, and other similar data that may be used by a particular wagering game. As an example, image data may include the appearance of the background layout for a wagering game. For a wagering game such as a Texas Hold 'Em variant, the background layout may appear as a casino table surface. In addition, image data may include including a copyrighted and/or trademarked game games and logos of the wagering game or an entity (e.g., a specific casino, website, application, etc.), as well as the desired appearance of the card backs and card faces. The various types of asset data requested by the client server 110 may depend on the wagering game, the entity, or other desires. Although the asset server 114 is shown as being behind the first firewall 102, in some embodiments, the asset server 114 may be communicate with the client server 110 outside of the first firewall 102.

The output format server 116 is configured to format the game data, wagering data, and graphics files to accommodate different end user devices of the client such that the client receives all data in a format that the client can process. For example, end user devices may include personal computers (PCs), smart phones (e.g., an iPhone, Android, Blackberry, etc.), laptops, tablets, gaming machines, and other electronic devices that may communicate with the client server 110 for a user to play a wagering game. The output format server 116 may detect the type of end user device, as well as the operating system, and configure the data as appropriate for the client to process.

The metrics server 118 is a business intelligence control system that analyzes usage of each server of the gaming system 100, enables data mining, generates reports, and detects system weaknesses and/or system failures. Each of the various servers of the gaming system 100 may communicate with the metrics server 118. The client server 110 may also communicate with the metrics server 118 regardless of whether or not the client server 110 is part of the gaming system 100. Each of the various servers self report information regarding its actions to the metrics server 118. For example, the client server 110 may send information regarding its actions to the metrics server 118. For example, the client server 110 may send information of actions such as "began load," "load complete," "started," and "ended action" along with payload data containing the time started, system specifications, and any other information that a business intelligence group may deem relevant. As another example, the game rules server 120 may self report information regarding its actions at the end of each hand, such as reporting the game outcome along with payload data like the amount wagered, the amount won, any bonuses, and any other information the business intelligence group may deem relevant. The other various servers of the gaming system 100 may likewise self report information regarding their actions. The data stored by the metrics server 118 may be mined to generate reports for review by the business intelligence group. Such reports may be available on demand, or according to a set schedule.

The deck database server 124 is configured to receive and store game piece indications (e.g., deck data) from the deck server 122 to maintain an historical record. Thus, the deck database server 124 may communicate directly with the deck server 122 without routing through the game routing server 112. The deck data that is stored in the deck database server 124 may be data that is desired to persist during the operation of the wagering game or that is not resolved in a single client communication. For example, in a Texas Hold 'Em variant game, multiple turns are performed prior to finishing a game. Deck data from intermediate turns may be stored in the deck database server 124. The deck data stored in the deck database server 124 may be analyzed, as a security measure. For example, the client server 110 may want a running report confirming that each virtual shoe used to deal blackjack was verified as having a complete set of cards at the beginning of the deal, that the correct cards remain in the virtual shoe after the cut card appears, and that the dispensed cards equal the composition of the set of cards used by the virtual shoe. The deck data stored in the deck database server 124 may be stored independently from deck data stored elsewhere in the gaming system 100. The deck database server 124 may also be used to retain card information (e.g., card sets, card usage, etc.) from current or previous rounds of play to verify jackpot hands. This card information may also be transferred to the archive server 126 described below.

The messages server 128 is configured to store a list of messages for display to the end user, and send the appropriate message to the client server 110 upon request. Examples of system messages for display to end users may include an indication that a particular wager made was not placed, unavailable, is deficient, an indication regarding the status of the game, that an award has been earned, as well as other messages. The various servers of the gaming system 100 may request that messages be sent to the client. The game routing server 112 may process these message requests, route the message requests to the messages server 128, and receive the appropriate messages. The game routing server 112 may determine when to deliver the messages to the client server 110, such as prioritizing the transmission of a plurality of received messages to ensure that critical messages are transmitted first.

The account server 130 includes data such as user information (e.g., user names, passwords, email address, other user information, etc.), user validation (e.g., logging in, logging out, timing out, etc.), as well as user financial information (e.g., account balance, currency conversion, credits, debits, etc.). As discussed above, in some embodiments the gaming system 100 may not actually perform the transfers of funds. In such an embodiment, the account server 130 acts as an intermediary with an external account to confirm that funds are available for wagering and to communicate whether funds should be debited or credited and the end of the wagering game. The account server 130 may integrate with multiple different account platforms (e.g., Ongame, CyberArts, OpenBet, etc.) for communicating with the external accounts. The gaming system 100 may include a separate account server 130 for each account platform type. Therefore, depending on the integrated partner (if any) of the gaming system 100, the account server 130 may be an internal account system or an abstracted library to an external account system. The account server 130 also manages player accounts in play for fun wagering activities that do not permit a player to cash out won credits. For example, the account server 130 may communicate with external accounts that support play for fun wagering activities, which may be different than the external accounts that support wagering activities.

The account server 130 may cache certain types of player data for repeat access. For example, basic information that can uniquely identify a player might be stored for a period (e.g., days). The account balance of the external account may not be cached, and may be retrieved on demand at each wager.

The archive server 126 may include various data collected from the gaming system 100. For example, the deck data generated in the deck server 122 may be stored in an archived deck database of the archive server 126 after a full wagering game is resolved. Because the full wagering game is completed, the deck data stored in the archive server 126 may be unsecured. For example, the deck data may be decrypted and stored in the archive server 126 along with other game data. The archive server 126 may be selectively accessible to customer service and business intelligence employees. As an example, if a customer service representative receives a call, they may need unsecured access to verify and check the deck data and the game data to see if there was a mistake in the game play, and resolving player and/or casino client payout disputes. The data stored in the archive server 126 may be held independently of any corresponding data held in other parts of the gaming system 100. In other embodiments, the data stored in the archive server 126 may be secured.

The archive server 126 may also perform post processing of the deck data to detect cheating by comparing deck data stored in the archive server 126 with deck data stored in a secured location, such as the deck server 122 or the deck database server 124. The archive server 126 may also have the ability to call for "shift keys" from each of the servers of the gaming system 100, and in the absence of receiving the keys from the other processors (indicating an acceptable game state), the archive server 126 may shut down the gaming system 100 as a further security measure. Arrows 127 are shown to indicate that the archive server 126 may communicate with each of the servers of the gaming system 100.

Other servers 132 are also contemplated that may be part of the gaming system 100. An example of such another server 132 includes a social server. A social server may be configured to receive information regarding the game outcome and share that information with a social media platform (e.g., Facebook, Google Plus, Twitter, etc.). For example, if an end user wins a poker hand, that information may be posted on the end user's Facebook wall. Another example of another server 132 is a player's club server. A player's club server may credit the end user with rewards such as reward points for certain events, such as frequent gaming.

As discussed above, the client server 110 may be a "thin client." As that term is used herein, the client server 110 may be little more than a script player. The client server 110 may simply send requests to the gaming system 100 rather than performing logic itself. In other words, the script stored in the client server 110 may merely include calls to functions that are externally defined. While the client may receive player inputs, the inputs are merely passed on to the game routing server 112, and the bulk of the processing of the game play is performed in the game rules server 120 and the deck server 122 described more fully below. The client may receive intermediate data and final game outcome information to display after such is determined by the game rules server 120. In addition, the externally defined functions may determine what information is displayed by the client as well as how it is displayed. Also, the assets are stored separately from the client server 110 on the asset server 114, which the client server 110 downloads while running the script. As a result, if certain features and displays are desired to be changed, the administrator of the gaming system 100 may do so without needing access to each and every client server 110 that may access the gaming system 100. As a result, modifications to the gaming system 100 may be done more efficiently, particularly for embodiments that include a third party entity that runs the client server 110 as a business partner with the administrator of the gaming system 100.

General operation of the gaming system 100 will now be discussed. The script for the client may be initiated, such as by being embedded in a webpage, opened by a computer file, opened as an application on a mobile device, etc. The end user interfaces with the client server 110 to play the wagering game. As discussed above, the script driver stored in the client server 110 enables the client server 110 communicate with the gaming system 100 to begin a wagering game. The client server 110 may initiate a game by communicating with the game rules server 120 through the game routing server 112. In response to initiating the desired wagering game, the script driver further enables the client server 110 to receive asset files (e.g., images, video, audio, etc.) from a game library in the asset server 114, and to transfer the corresponding asset files to the client server 110 to be presented by the end-user's game display. As an example, the client server 110 may inform the game routing server 112 that a game is to be initiated. The game routing server 112 may query the asset server 114 to determine what assets are needed to run the desired wagering game and return the asset list to the client server 110. The client server 110 may receive an asset list from the game routing server 112 for the particular wagering game selected. The client server 110 may request the assets directly from the asset server 114 according to the asset list provided. Given such an asset list, the game routing server 112 may cache the asset list for future use if contacted by the client server 110 or another client server 110 to initiate another wagering game of the same type.

Once set up of the wagering game is complete, the client server 110 may communicate to the game routing server 112 that the wagering game is ready to begin. The end user may play wagering game according to the game rules stored in the game rules server 120. As discussed above, the game routing server 112 may route information between the client server 110 and between the various servers of the gaming system 100. For example, the end user may input information (i.e., press buttons on the display) that communicate to the game routing server 112 the desired actions. As a thin client, the client server 110 may not have the logic to know what the actions mean, just that a certain button is selected. The game rules server 120 is configured to interpret that information for the particular wagering game being played. Also, as discussed above, the game rules server 120 and the deck server 122 communicate to request the random game pieces according to the game play as defined in the game rules of the wagering data stored in the game rules server 120. The random game pieces (e.g., deck data) may be shared with the game rules server 120 and the client server 110 at the appropriate times according to the game play, wagers, and other factors. Accordingly, the game rule data and game outcome data are kept separate and not accessible without authorization.

As an example of game play, the game rules server 120 may include a plurality of different states that are moved between depending on the game. A first state may include the selection of the wagering game to be played. The next state may be to wait for the bet to be placed. If it has not done so already, the account server 130 may communicate with the external accounts to verify the funds for a player (i.e. an end user) are available to be bet. After the bet is placed, a game piece (e.g., such as one or more cards) may be issued to the player. Depending on the specific game rules, additional bets may be made and intermediate game pieces may be issued. Another state may be to do a final verification of the bets for sufficient funds for the player, after which the final game pieces may be sent to the game rules server 120 and the game outcome may be determined. Credits or debits are made to the end user's account through the account server 130 depending on the outcome of the wagering game and the bet and/or additional bet placed by the end user.

The gaming system 100 includes a plurality of different server components, each serving a separate function. The gaming system 100 is also separated in different levels of sub-systems 101, 103 that have limited communication therebetween. For example, communication from the client server 110 to the servers of the second sub-system 103 may occur through the game routing server 112 adding an extra level (and extra firewall) of security to the more sensitive components of the gaming system 100, such as the game rules server 120, the deck server 122 and the account server 130. These sensitive components of the gaming system 100 are, therefore, isolated from the client server 110, and any attempts that may be made to gain unauthorized access to the second sub-system 103 via the client server 110, also require passing the security measures implemented for the first sub-system 101. Therefore, the risks of an anomaly caused by an intruder being undetected may be reduced because an intruder may need to access multiple servers undetected in order to successfully hide any alterations made to one of the servers (such as the deck server 122, the game rules server 120, or the account server 130).

In addition to the security benefits described above, embodiments of the present disclosure may result in cost benefits as well. For example, scaling of the gaming system 100 may be performed in a more efficient manner according to the embodiments of the present disclosure. By separating the data and functions performed into separate servers, some of the servers may be duplicated to increase the scale of the gaming system 100 without the need to duplicate or replace other servers having other functions. For example, the game rules server 120 may be duplicated as additional games are added to the gaming system 100, as additional client servers 110 are added to the gaming system 100, or when additional players access the gaming system 100. On the other hand, other system servers may not require scaling (e.g., duplication) at the same time the game rules server 120 demand increases. As another example, changing the assets stored on the asset server 114 may be accomplished with only minor modifications (if any) to the other servers of the first sub-system 101 (such as updating the list of assets available), and without any of the servers of the second sub-system 103 requiring modification.

Servers may also be scaled at different rates. For example, the account server 130 may need to increase in scaling prior to the need to increase the scaling of the asset server 114. As another example, as different end user devices are developed, the output format server 116 may require reconfiguration, but not the balance of the gaming system 100. Scaling may occur as new features or information are changed by the administrator. Increasing and decreasing the scaling of the individual servers of the gaming system 100 may also be performed as a result of a need to keep up with the changing demand during player usage of the gaming system 100. Conventional approaches that essentially combine functions of all of the above servers into a single non-separated server may result in unnecessary duplication of data as the system is scaled to meet demand.

It is contemplated that embodiments of the present disclosure include architectures wherein at least some of the functionality of the various servers may be combined. Doing so, however, may at least partially reduce some of the efficiencies of scalability described above. An example of such includes a server that at least partially combines the functionality of two or more of the metrics server 118, the messages server 128, and the account server 130. Another example includes a server that at least partially includes the functionality of two or more of the game routing server 112, the game rules server 120, and the output format server 116.

In addition, another method of segregating data and functions into a plurality of different servers may include segregation of servers by whether or not the data or software code is regulated by gaming regulation authorities. Such segregation may reduce costs associated with satisfying regulatory requirements over time.

As discussed above, the gaming system 100 may include wagering games on a play for pay basis, wherein the gaming system 100 manages accounts (whether internal or external to the gaming system 100) that are adjusted according to the game outcome, and that permit a player to cash out. In some embodiments, the gaming system 100 may include wagering games on a play for fun basis, wherein the gaming system 100 manages accounts (whether internal or external to the gaming system 100) that are adjusted according to the game outcome, and that do not permit a player to cash out. For example, a player may be issued (e.g., through purchase) credits (or another symbol) that may be used to place wagers during the wagering game. During game play, the credits may be increased or decreased according to the game outcome. As the credits expire, the player may need additional credits before continuing additional play. The additional credits may be purchased or issued through other methods, as described above.

The play for pay feature and the play for fun feature may be at least partially integrated into the same gaming system 100. In other words, the gaming system 100 may be configured as a dual-purpose internet platform such that the various servers (e.g., game routing server 112, game rules server 120, deck server 122, etc.) of the gaming system 100 may be shared by client servers 110 simultaneously running play for pay and play for fun wagering games. The dual-purpose internet gaming platform is configured to run a play for pay wagering game and a play for fun wagering game according to an at least partially integrated architecture that manages player accounts. The play for pay wagering game enables a user to cash out from the player accounts, and the play for fun wagering game does not enable the user to cash out from the player accounts. Partial integration means that at least two of the servers of the gaming system 100 are shared for performing play for pay and play for fun features. For example, the game rules server 120 and the deck server 122 may be used to perform both play for pay and play for fun features. In some embodiments, full integration may be achieved for all servers of the gaming system 100 to perform play for pay and play for fun features. Of course, in some embodiments, the play for pay and the play for fun features may have their own separate gaming systems 100. In other words, each gaming system 100 may be configured as a single-purpose platform to run the play for pay and the play for fun features, if both sets of features are present. Other embodiments may include at least a partial integration of gaming systems 100 that run both play for pay and play for fun features, such that one or more servers are shared.

In some embodiments, the client servers 110 that run the play for pay features of the dual-use internet platform may be separate from the client servers 110 that run the play for fun features of the dual-purpose platform. For example, the dual-purpose internet gaming platform may receives function calls from different client servers 110 to run the play for pay wagering game and the play for fun wagering game. In other embodiments, the client servers 110 that run the play for pay and the play for fun features may be the same. For example, the client servers 110 may be configured to send functions calls associated with both the play for pay wagering game and the play for fun wagering game from the same client server 110.

Figure 1B:
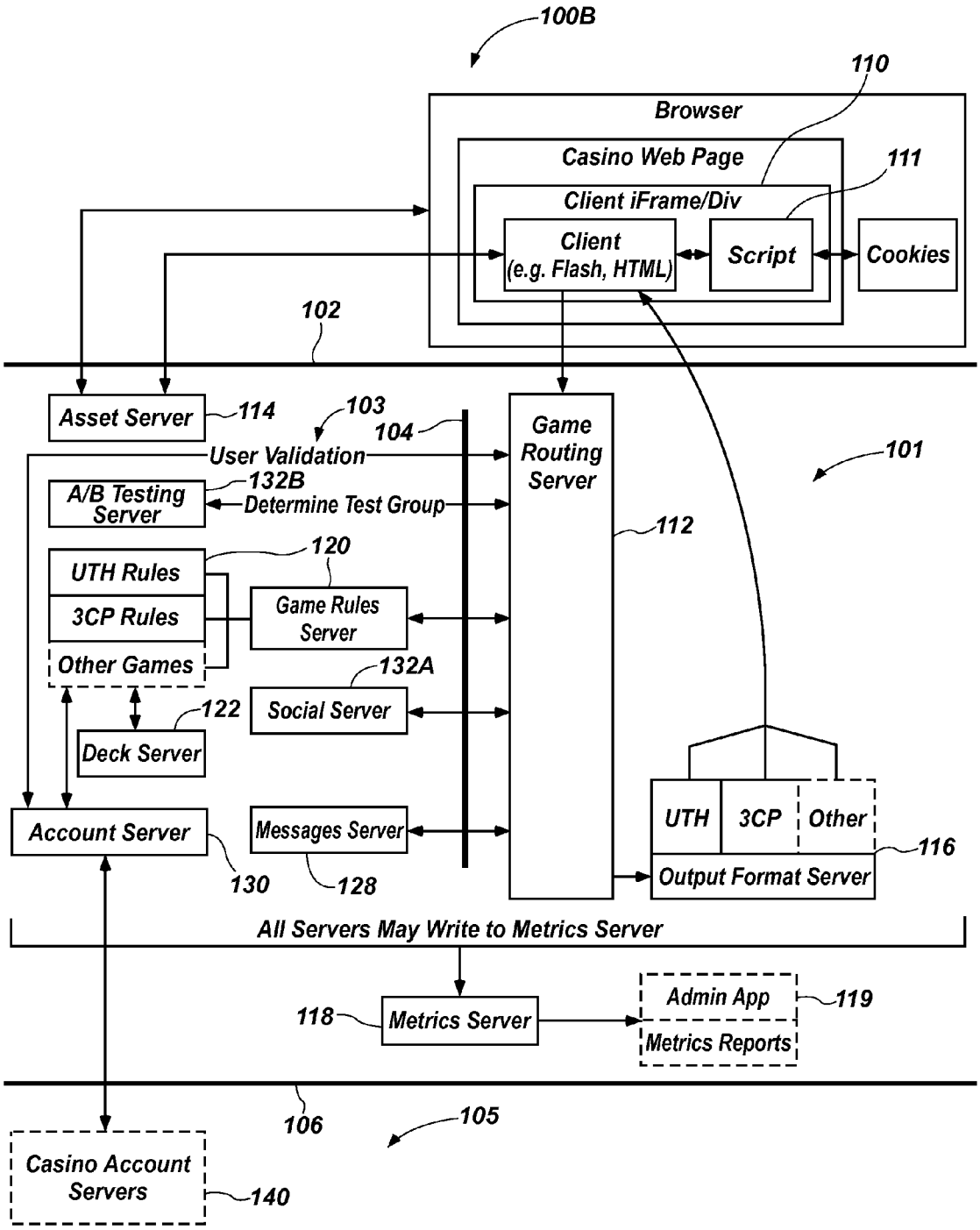
FIG. 1B is a schematic block diagram of a gaming system showing data flow according to an embodiment of the present disclosure.

FIG. 1B is a schematic block diagram of a gaming system 100B showing data flow according to an embodiment of the present disclosure. The gaming system 100B includes the various servers described above with respect to the gaming system 100A of FIG. 1A.

As discussed above, the client server 110 may communicate with the servers of the first sub-system 101, such as through the first firewall 102. For example, the client server 110 may be authorized to communicate with the game routing server 112, the asset server 114, the output format server 116, and the metrics server 118, whereas other servers may not be authorized for such communication. The asset server 114 may receive requests from the client server 110 for delivering assets to the client as discussed above. The game routing server 112 may receive instructions from the client server 110 related to playing a particular wagering game supported by the gaming system 100B. Communication from the game routing server 112 back to the client server 110 may flow through the output format server 116, which may be configured to prepare the data in an appropriate format to be processed by the end user device coupled with the client server 110. The client server 110 may include a client program embedded in a web page (e.g., casino web page) that is operable in a web browser. The client program may be supported by an inline floating frame (iFrame) or div elements. The client program may be written in an appropriate language such as HTML or Flash. As discussed above, the client server 110 may be provided with a relatively small amount of script 111 (e.g., JavaScript), also referred to as a "script driver," including scripting language that controls the interfacing of the client server 110 with the gaming system 100. The client server 110 may be a thin client to provide the client with the ability to communicate with the gaming system 100 by sending requests to the gaming system 100 rather than performing logic itself. In other words, the script 111 may merely include calls to functions that are externally defined.

As further discussed above, the game routing server 112 may communicate with the servers of the second sub-system 103, such as through the second firewall 104. For example, the game routing server 112 may be authorized to communicate with the game rules server 120, the messages server 128, the account server 130, and possibly the other servers 132, whereas non-authorized servers may not be permitted for such communication. In some embodiments, the deck server 122 may not be configured to communicate directly with the game routing server 112. Instead, the game rules server 120 may be authorized to communicate with the deck server 122.

The other servers 132 shown in FIG. 1B are the social server 132A and an A/B testing server 132B. The social server 132A may integrate features with various social media platforms (e.g., Facebook, Google Plus, Twitter, etc.). The A/B testing server 132B may develop testing groups for analysis of game play. The A/B testing server 132B may be responsible for multivariate testing to generate tests, such as to try out new features for the gaming system 100. Each test performed by the A/B testing server 132B may be defined by the percentage of users in each test group (including a control group). For example, when a user accesses the gaming system 100, the A/B testing server 132B may determine which group (if any) the user belongs to for running a test. If the user does not belong to a testing group, the user is randomly assigned to a testing group weighted by the desired percentage of users for each testing group. Each server of the gaming system 100 may operate differently according to which testing group the user belongs to according to what feature is being tested. The various servers of the gaming system 100 may query the A/B testing server 132B for the user's testing group and makes decisions based on the testing group of the user. For example, the asset server 114 may make a decision regarding which image to show or which audio file to play based on the testing group of the user. Other decisions that may be affected by different testing groups may include which pay table to use, or any logic that can be branched using a decision tree in the corresponding server of the gaming system 100.

The deck database server 124 and the archive server 126 are not shown in FIG. 1B, but may be included with the gaming system 100B to perform the functions described above with respect to FIG. 1A. The metrics server 118 may receive metrics data from each of the servers of the gaming system 100B (or the gaming system 100A for the embodiment of FIG. 1A). For example, the metrics server 118 may log metrics data for operations from each server of the first sub-system 101 and the second sub-system 103. The metrics server 118 may generate metrics reports for administrators to review, such as part of an administrator application 119.

The game routing server 112 may route information between the servers of the second sub-system 103 and the client server 110 during game play. The game rules server 120 may include rules for one or more wagering games, such as the Ultimate Texas Hold 'Em® (UTH) poker game, Three Card Poker (3CP) game, and other games. The wagering games may be card based, or non-card based as previously discussed. The game rules server 120 may communicate with the deck server 122 to generate the game piece indication as requested by the game rules server 120. The deck server 122 is configured to generate and output the game piece indication to the game rules server 120 in response to the request, such that the game piece indication is unavailable to the game rules server 120 until requested. In other words, the game piece indication information may not be available to the game rules server 120 until required for determining game outcome information at the desired time. For example, the deck server 122 may share the game piece indication information with the game rules server 120 after the game rules server 120 verifies that a proper wager has been made, and that advancing the game to the next decision by the player is appropriate, or that determining the final game outcome information is appropriate. Prior to such a determination, the deck server 122 may wait to provide such data to the game rules server 120. The verification of a proper wager may include the game rules server 120 communicating with the account server 130 to verify that the user account has sufficient funds to cover the wager.

As discussed above, the account server 130 may communicate with external accounts (e.g., casino account servers 140) that perform the actual maintenance of the user accounts, including executing debits, credits, and maintaining the funds of the end user. Thus, the casino account servers 140 and other external servers may be operated by one or more third parties to the gaming system 100B and may be considered part of a third sub-system 105, which may not be part of the gaming system 100B. In addition, the account server 130 may communicate with the casino account servers 140 and other external servers through a third firewall 106. In some embodiments, such as when a casino may operate the entire operations including the game play, content, client support, and account management and activity, the casino account servers 140 may be included as part of the gaming system 100B. The casino account servers and other external servers may be considered a third sub-system 105 of the gaming system 100B.

Figure 2:
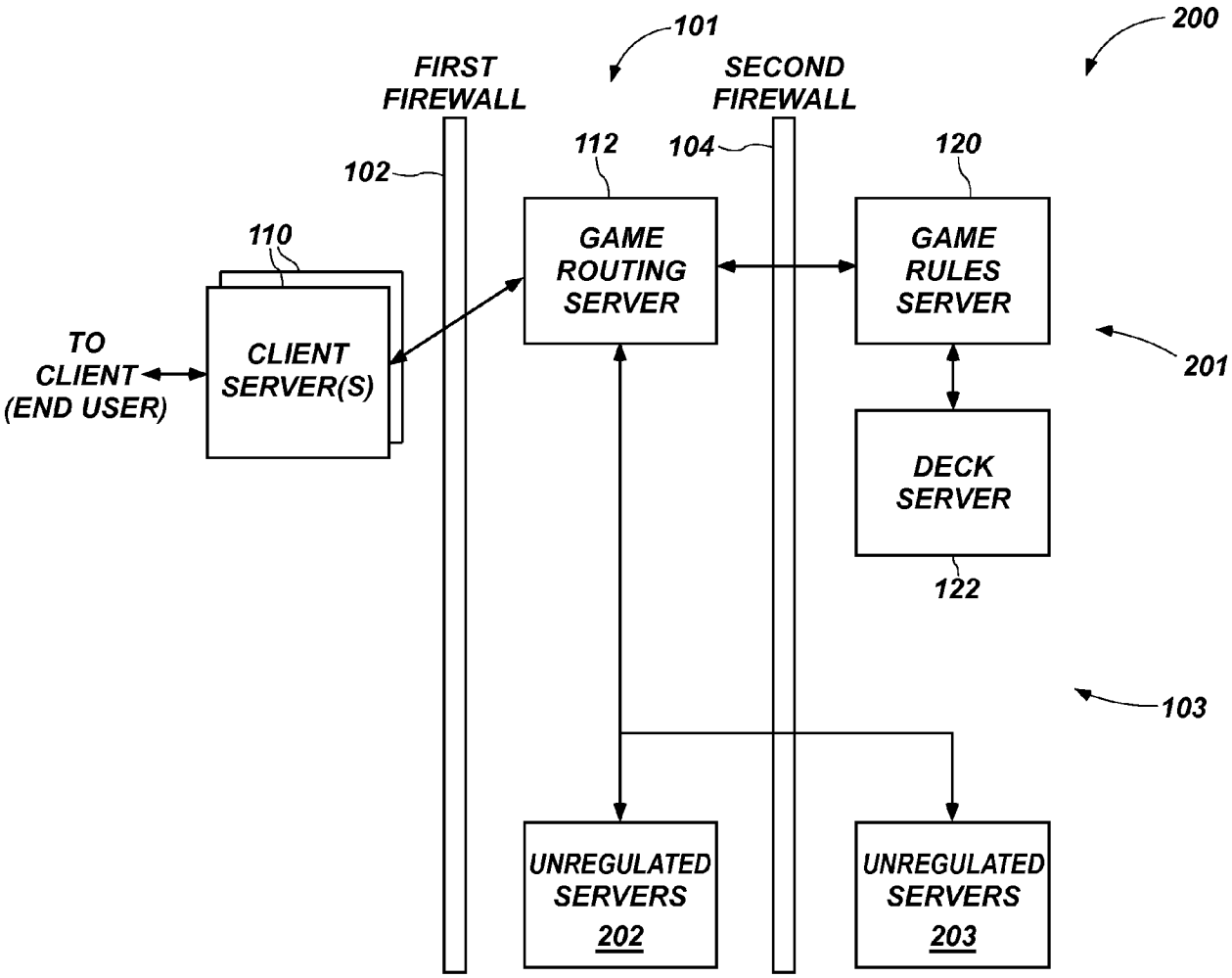
FIG. 2 is a schematic block diagram of a gaming system according to an embodiment of the present disclosure.

FIG. 2 shows a gaming system 200 according to an embodiment of the present disclosure. The gaming system 200 shows the separation of regulated servers 201 and unregulated servers 202, 203. That is, the regulated servers 201 include servers that are anticipated to be subject to gaming authority regulation, while unregulated servers 202, 203 are not anticipated to be subject to such regulation. The regulated servers 201 may include certain functions such as those described by client server 110, the game routing server 112, the game rules server 120, and the deck server 122. Prior to launch of gaming system 200, government regulators may investigate the functionality of these regulated servers 201 to ensure that applicable laws and regulations are complied with. Reconfigurations or updates to any of these servers may require further regulatory approval.

The unregulated servers 202, 203 may include one or more of the asset server 114, the output format server 116, the metrics server 118, the deck database server 124, the archive server 126, the messages server 128, the account server 130, and other servers 132, which are individually shown and described with respect to FIG. 1A. The unregulated servers 202, 203 may be updated without regulatory impact as opposed to conventional methods that combine regulated functions and unregulated functions within the same server. For example, if the functionality of the asset server 114 were combined with the game rules server 120, regulatory approval would be required for updating that server just to include a new image for a game. As a result, the time and costs associated with receiving regulatory approval may be substantially reduced by segregating functions of different servers. Of course, it is contemplated that laws and regulations may change over time and according to jurisdiction, such that the functions described herein as requiring regulation may not need regulation in the future, and vice versa.

The embodiments of the present disclosure are described in terms of the various servers of the gaming system 100 (FIGS. 1A, 1B), 200 (FIG. 2) being separated from each other. Discussion of having a separate (i.e., different) server is not to be understood as requiring physical separation of each server, but rather, as being logically separated from each other. Of course, physical separation and differentiation of one or more of the servers is contemplated as an embodiment of the present disclosure. In other words, one or more of the servers may be a physically separate server that communicates with the other physically separate servers. That is, each physically separate server may include its own processor and associated memory, such that the memory is specifically programmed to control the processor to execute instructions that perform the functionality and inter-communication described herein. In some embodiments, the functionality of one or more servers may share physical resources, such as being hosted by one or more shared physical servers. In other words, physical hardware (e.g., processor, memory, etc.) may be shared; however, the data and functionality of the different servers of the gaming system 100 may remain logically separate. As a result, the separate data, firewalls, communication links, and other relationships between the various servers of the gaming system 100, 200 may remain intact without compromising the security and scaling benefits described herein. In fact, using shared physical resources may even further enhance the scaling benefits as the gaming system 100, 200 reaches certain levels of growth. As an example, the various servers of the gaming system 100, 200 may be configured according to a cloud architecture (i.e., using principles of cloud computing as understood by those skilled in the art). Therefore, the general term "server" includes physical servers as well as virtual servers that may share physical resources of one or more physical servers.

Figure 3:
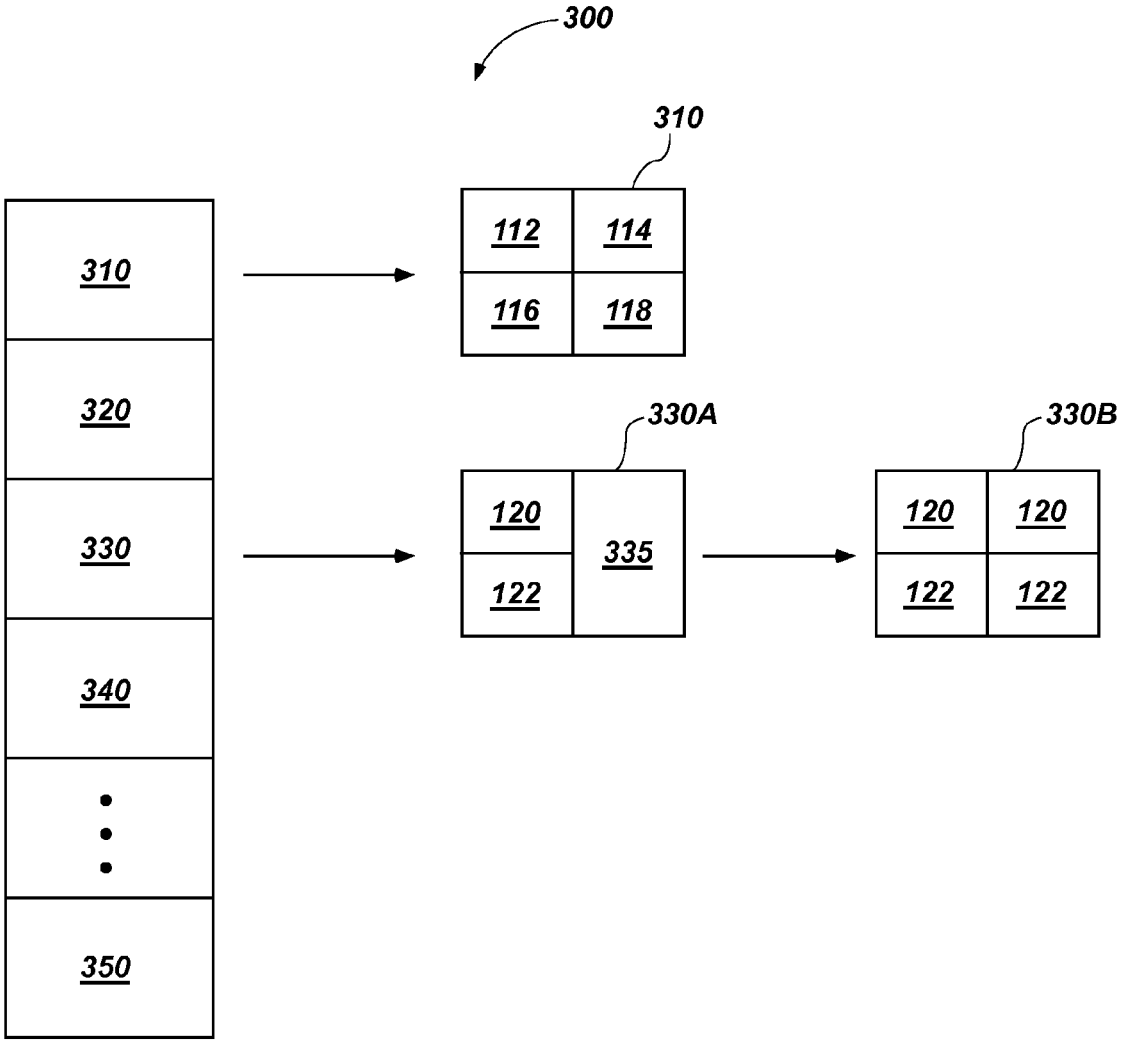
FIG. 3 is a server architecture of a gaming system with the various servers of the gaming system sharing physical resources according to an embodiment of the present disclosure.

FIG. 3 is a server architecture 300 of a gaming system (e.g., gaming system 100, 200) with the various servers of the gaming system sharing physical resources according to an embodiment of the present disclosure. The server architecture 300 includes a plurality of servers 310, 320, 330, 340, 350 that are configured to host the various server functions of the gaming system 100, 200 that is described above with respect to FIGS. 1A, 1B, and 2. For example, the plurality of servers 310, 320, 330, 340, 350 may generate instances of virtual servers that share physical resources, such as part of a cloud computing architecture. While five servers are shown in FIG. 3, any number of servers is contemplated according to the capacity needs of the gaming system. It is to be understood that a "virtual server" falls within the definition of the term "server" for purposes of this disclosure.

Each of the various server functions of the gaming system may be hosted by at least one of the plurality of servers 310, 320, 330, 340, 350; however, only a portion of the various servers of the gaming system is actually shown, for convenience. For example, only the game routing server 112, the asset server 114, the output format server 116, the metrics server 118, the game rules server 120, and the deck server 122 are shown. It should be understood, however, that the plurality of servers 310, 320, 330, 340, 350, as a whole, host the other servers of the gaming systems described above. In addition, each of the plurality of servers 310, 320, 330, 340, 350 are to be understood as being physical servers of the server architecture 300, whereas the servers (e.g., 112, 114, 116, 118, 120, 122, and others) of the gaming system are to be understood as "virtual servers." That is, the server architecture 300 generates instances of the servers of the gaming system to have the relationships with each other as described above. For example, a first server 310 may generate virtual servers (i.e., instances) for the game routing server 112, the asset server 114, the output format server 116, the metrics server 118, while a third server 330 may generate virtual servers for the game rules server 120, and the deck server 122. The other servers (e.g., second server 320, fourth server 340, fifth server 350, and so on) may generate and host virtual servers for the other server functions of the gaming system. When the virtual servers are generated, the server architecture 300 does so according to the communication rules and logical separation set by the architecture rules. As a result, the various servers of the gaming system may share physical resources with each other while still maintaining the logical separation and communication relationships described above.

The specific configuration shown is to be understood as an example of one embodiment, and individual server functions may be combined within the same physical server according to any combination of the various servers of the gaming system. For example, even through the first server 310 is shown to generate virtual servers for the game routing server 112, the asset server 114, the output format server 116, the metrics server 118, another combination may include another combination such as the account server 130, the game routing server 112, the game rules server 120, the deck server 122, and the messages server 128. Thus, virtual servers for the first sub-system 101 may be combined with virtual servers for the second sub-system 103. Therefore, each of the physical servers 310, 320, 330, 340, 350 may generate and host virtual servers of any number or combination according to the capacity of the server.

During operation of the gaming system, the usage may vary such that one or more of the individual virtual servers may fluctuate in needed capacity. For example, at one point in time, the third server 330A may host a single instance each of the game rules server 120 and the deck server 122. At this point in time, the third server 330A may have unused server space 335 that is available for use, if needed. At another point in time, the usage of the gaming system may increase. The server architecture 300 may determine that another instance for each of the game rules server 120 and the deck server 122 is needed to meet the increased usage demand of the gaming system. As a result, the third server 330B may generate another instance for each of the game rules server 120 and the deck server 122 to occupy the unused server space 335 during that time of increased demand. As usage fluctuates over time, the server architecture 300 may increase and decrease the number of instances of the virtual servers for the gaming system to adjust in real time to the demands of the gaming system.

Figure 4:
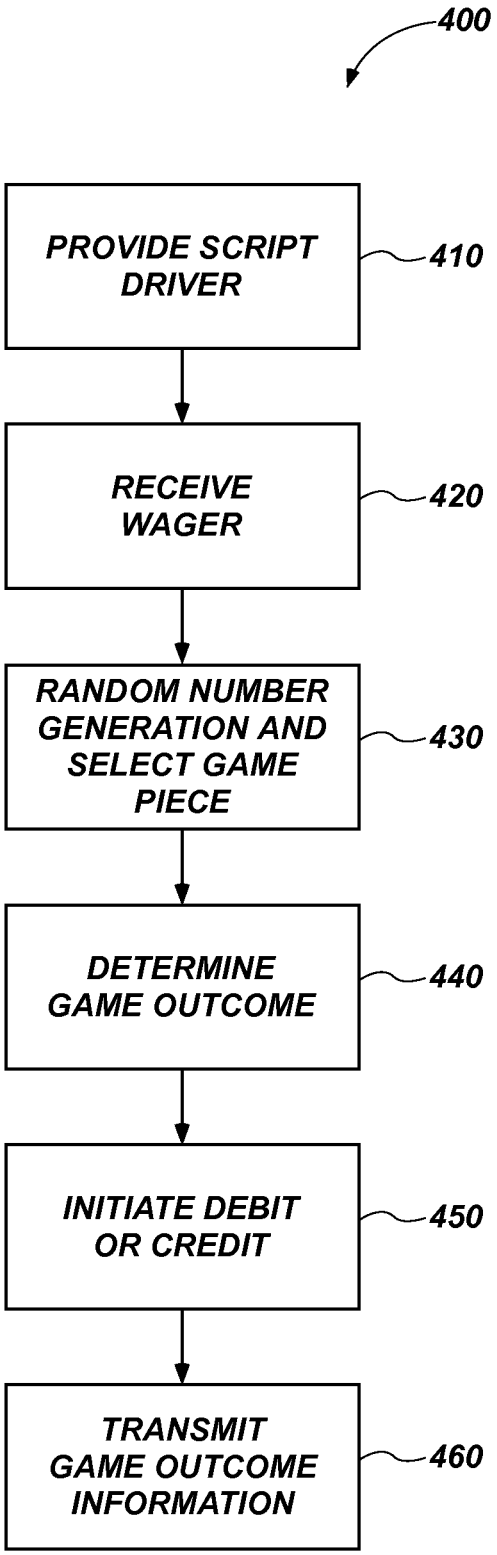
FIG. 4 is a flow chart illustrating a method of enabling the play of on-line wagering games according to an embodiment of the present disclosure.

FIG. 4 is a flow chart 400 illustrating a method of enabling the play of on-line wagering games according to an embodiment of the present disclosure. At operation 410, code (e.g., a script driver) may be provided on a client server to enable access to an on-line wagering platform having a game rules server and a deck server. At operation 420, at least an indication of a placed wager may be received from the client server. At operation 430, at least one number used for selecting a virtual game piece for an on-line wagering game may be randomly generated. The random number generation may occur in hardware, software, or both, in the deck server. Virtual game pieces may be virtual cards, virtual dice, virtual roulette numbers, scratch off numbers, virtual wheels, color combinations, and other randomly generated components of a wagering game. The type of game piece, and the order of game play may be determined by the game rules stored on the game rules server. As discussed above, the game rules server and the deck server may be separate servers that perform separate functions and maintain separate data. The deck server may share deck data with the game rules after the game server verifies that a proper wager has been made, and for advancing the game to the next decision by the player or for determining game outcome information. Prior to such a determination, the deck server may wait to provide such data to the game rules server. At operation 440, a game outcome on the on-line wagering platform may be determined according to game rules stored in the game rules server. At operation 450, a debit or credit may be initiated according to the game outcome. At operation 460, the game outcome information may be transmitted to the client server. The game outcome information and other communication may occur through a game routing server coupled with the various servers of the on-line wagering platform.

CONCLUSION

Embodiments of the present disclosure include a gaming system for enabling secure on-line gaming through a client server. The gaming system comprises a gaming platform to communicate with a client server to support play of a wagering game by an end user. The gaming platform comprises a game rules server configured to administer a set of game rules for the wagering game, and a deck server to randomly select game pieces according to the set of game rules.

Another embodiment of the present disclosure includes a network gaming architecture. The network gaming architecture comprises a plurality of regulated servers that require validation from gaming authorities for reconfiguration of each of the plurality of regulated servers, and at least one unregulated server that does not require validation from gaming authorities for reconfiguration of the at least one unregulated server. The regulated servers include a game rules server storing game rules for a wagering game, and a deck server coupled with the game rules server. The deck server is configured to randomly select game pieces for the wagering game in response to requests received from the game rules server. The at least one unregulated server is configured to support an additional function of the gaming system.

Another embodiment of the present disclosure includes a client server for accessing a remote gaming engine, the client server comprising a computer readable medium having instructions stored thereon. When executed by a processor, the instructions cause the processor to establish a communication link with a remote gaming engine to execute a wagering game, and receive inputs from an end user and transmit the inputs to the remote gaming engine during play of the wagering game. The client server acts as a thin client to the remote gaming engine such that the remote gaming engine performs game play processing.

In another embodiment of the present disclosure, a method of enabling the play of on-line wagering games is disclosed. The method comprises providing code on an external client server to enable access to an on-line wagering platform having a game rules server and a deck server, receiving at least an indication of a placed wager from the external client server, randomly generating at least one number in the deck server, the at least one number used for selecting a virtual game piece for an on-line wagering game, determining a game outcome on the on-line wagering platform according to game rules stored in the game rules server, and transmitting the game outcome information to the external client server.

In another embodiment of the present disclosure, a dual-purpose internet gaming platform is configured to run both a play for pay wagering game and a play for fun wagering game according to an at least partially integrated architecture that manages player accounts. The play for pay wagering game enables a user to cash out from the player accounts, and the play for fun wagering game does not enable the user to cash out from the player accounts.

In another embodiment, a system for the provision of gaming over a network is disclosed. The system comprises a game rules server configured to receive an input associated with a game and to output a game outcome based on one or more game rules and a game piece indication, and a deck server separate from, and in communication with, the game rules server. The game rules server is further configured to request the game piece indication from the deck server. The deck server is configured to generate and output the game piece indication to the game rules server in response to the request, such that the game piece indication is unavailable to the game rules server until requested.

In another embodiment, a method for the provision of gaming over a network is disclosed. The method comprises receiving, at a game rules server, an input associated with a game. The method further comprises outputting, from the game rules server, a game outcome based on one or more game rules and a game piece indication. The method further comprises requesting, at the game rules server, the game piece indication from a deck server, and generating and outputting the game piece indication to the game rules server from the deck server in response to the request, such that the game piece indication is unavailable to the game rules server until requested, wherein the deck server is separate from and in communication with the game rules server.

Another embodiment includes a gaming system for enabling secure on-line gaming through a client server. The gaming system comprising a gaming platform to communicate with a client server to support play of a wagering game by an end user. The gaming platform includes a game engine configured to administer a set of game rules for the wagering game and to randomly select game pieces according to the set of game rules, and a game routing server separate from the game engine. The game routing server is configured to route communication between the client server and the game engine.

While the present disclosure has been described herein with respect to certain illustrated embodiments, those of ordinary skill in the art will recognize and appreciate that the present disclosure is not so limited. Rather, many additions, deletions, and modifications to the illustrated and described embodiments may be made without departing from the scope of the invention as hereinafter claimed along with their legal equivalents. In addition, features from one embodiment may be combined with features of another embodiment while still being encompassed within the scope of the invention as contemplated by the inventors.

What is claimed is:

1. A network gaming architecture, comprising:

a plurality of regulated servers, including:

a game rules server storing game rules for a wagering game; and a deck server coupled with the game rules server, and configured to randomly select game pieces for the wagering game in response to requests received from the game rules server; and at least one unregulated server configured to support an additional function of the gaming system, wherein reconfiguration of at least one of the plurality of regulated servers requires validation from gaming authorities, and wherein reconfiguration of the at least one unregulated server does not require validation from the gaming authorities;

wherein each of the plurality of regulated servers and the at least one unregulated server scale to meet increased demand at a different rate.

2. The network gaming architecture of claim 1, wherein access privileges to the game rules server are different than access privileges to the deck server.

3. The network gaming architecture of claim 1, wherein the plurality of regulated servers and the at least one unregulated server are configured as a cloud computing architecture.

4. A method of enabling the play of on-line wagering games, comprising:

providing code on an external client server to enable access to an on-line wagering platform having a game rules server and a deck server;

receiving at least an indication of a placed wager from the external client server;

randomly generating at least one number in the deck server, the at least one number used for selecting a virtual game piece for an on-line wagering game;

determining a game outcome on the on-line wagering platform according to game rules stored in the game rules server;

transmitting the game outcome information to the external client server; and generating a plurality of instances of virtual servers for the game rules server and the deck server in response to an increase of usage in play of the on-line wagering games.

5. The method of claim 4, wherein selecting a virtual game piece includes selecting virtual cards from a stored set of virtual cards to dispense into the on-line game.

6. The method of claim 4, further comprising routing the game outcome information from the game rules server to the external client server through a game routing server.

7. The method of claim 4, further comprising waiting to transfer information regarding the virtual game piece from the deck server to the game rules server until after verifying that an appropriate wager has been placed.

8. A network gaming architecture, comprising:

a plurality of regulated servers, including:

a game rules server storing game rules for a wagering game; and a deck server coupled with the game rules server, and configured to randomly select game pieces for the wagering game in response to requests received from the game rules server; and at least one unregulated server configured to support an additional function of the gaming system, wherein reconfiguration of at least one of the plurality of regulated servers requires validation from gaming authorities, and wherein reconfiguration of the at least one unregulated server does not require validation from the gaming authorities;

wherein access privileges to the game rules server are different than access privileges to the deck server.

9. The network gaming architecture of claim 8, wherein each of the plurality of regulated servers and the at least one unregulated server scale to meet increased demand at a different rate.

10. The network gaming architecture of claim 8, wherein the plurality of regulated servers and the at least one unregulated server are configured as a cloud computing architecture.

11. A network gaming architecture, comprising:

a plurality of regulated servers, including:

a game rules server storing game rules for a wagering game; and a deck server coupled with the game rules server, and configured to randomly select game pieces for the wagering game in response to requests received from the game rules server; and at least one unregulated server configured to support an additional function of the gaming system, wherein reconfiguration of at least one of the plurality of regulated servers requires validation from gaming authorities, and wherein reconfiguration of the at least one unregulated server does not require validation from the gaming authorities;

wherein the plurality of regulated servers and the at least one unregulated server are configured as a cloud computing architecture.

12. The network gaming architecture of claim 11, wherein each of the plurality of regulated servers and the at least one unregulated server scale to meet increased demand at a different rate.

13. The network gaming architecture of claim 11, wherein access privileges to the game rules server are different than access privileges to the deck server.

* * * * *